US008317367B2

(12) United States Patent
Venhaus

(10) Patent No.: US 8,317,367 B2
(45) Date of Patent: Nov. 27, 2012

(54) SOLID STATE OPTICAL SYSTEM

(75) Inventor: David A. Venhaus, West Allis, WI (US)

(73) Assignee: Illumination Optics Inc., Wauwatosa, WI (US)

( * ) Notice: Subject to any disclaimer, the term of this patent is extended or adjusted under 35 U.S.C. 154(b) by 437 days.

(21) Appl. No.: 12/719,102

(22) Filed: Mar. 8, 2010

(65) Prior Publication Data

US 2010/0157607 A1 Jun. 24, 2010

Related U.S. Application Data

(63) Continuation-in-part of application No. 12/115,020, filed on May 5, 2008, now Pat. No. 7,794,119.

(60) Provisional application No. 60/927,953, filed on May 7, 2007.

(51) Int. Cl.
*F21V 7/00* (2006.01)

(52) U.S. Cl. ..... 362/301; 362/296.07; 362/346; 362/241; 362/247; 362/297

(58) Field of Classification Search ..... 138/146, 138/97, 145; 428/36.1, 423.1; 362/346, 362/297, 296.07, 296.08, 311.07, 241, 249.02, 362/247, 245, 243, 304, 298, 301, 302
See application file for complete search history.

(56) References Cited

U.S. PATENT DOCUMENTS

| | | | | |
|---|---|---|---|---|
| 3,679,893 | A * | 7/1972 | Shemitz et al. | 362/345 |
| 4,517,631 | A * | 5/1985 | Mullins | 362/346 |
| 4,748,543 | A * | 5/1988 | Swarens | 362/147 |
| 4,974,137 | A | 11/1990 | Evans, Jr. | |
| 5,032,958 | A * | 7/1991 | Harwood | 40/559 |
| 5,272,570 | A | 12/1993 | Yoshida et al. | |
| 5,704,709 | A | 1/1998 | Zwick et al. | |
| 6,318,886 | B1 | 11/2001 | Stopa et al. | |

(Continued)

FOREIGN PATENT DOCUMENTS

JP 18294598 A 10/2006

(Continued)

OTHER PUBLICATIONS

European Extended Search Report issued Mar. 18, 2011 for European Application No. 08747625.5 corresponding to U.S. Appl. No. 12/115,020, 7 pages.

(Continued)

*Primary Examiner* — Bao Q Truong
(74) *Attorney, Agent, or Firm* — Michael Best & Friedrich LLP

(57) ABSTRACT

A light fixture includes a solid state light emitter having first and second light-emitting portions configured to emit first and second portions of the light, respectively. The light fixture also includes a reflector having a first reflective surface positioned in the path of the light and including a first substantially parabolic section configured to reflect the first portion of the light, and a second substantially parabolic section adjacent the first substantially parabolic section and configured to reflect the second portion of the light. The second substantially parabolic section has a focal length greater than that of the first substantially parabolic section. The light fixture also includes a stray light reflector having a second reflective surface facing the first reflective surface. The first reflective surface reflects a part of the light toward the stray light reflector, and the stray light reflector is configured to reflect the part of the light.

33 Claims, 20 Drawing Sheets

U.S. PATENT DOCUMENTS

| | | | | |
|---|---|---|---|---|
| 6,457,850 | B2 * | 10/2002 | Oyama et al. | 362/517 |
| 6,502,963 | B1 * | 1/2003 | King | 362/297 |
| 6,601,970 | B2 | 8/2003 | Ueda et al. | |
| 6,641,284 | B2 | 11/2003 | Stopa et al. | |
| 6,796,695 | B2 | 9/2004 | Natsume | |
| 6,814,480 | B2 | 11/2004 | Amano | |
| 6,848,820 | B2 | 2/2005 | Natsume | |
| 6,945,672 | B2 | 9/2005 | Du et al. | |
| 6,966,675 | B2 | 11/2005 | Albou | |
| 7,040,782 | B2 | 5/2006 | Mayer | |
| 7,156,544 | B2 | 1/2007 | Ishida | |
| 7,160,004 | B2 | 1/2007 | Peck | |
| 7,178,960 | B2 | 2/2007 | Ishida | |
| 7,207,697 | B2 | 4/2007 | Shoji | |
| 7,213,949 | B2 | 5/2007 | Ford et al. | |
| 7,261,439 | B2 | 8/2007 | Sormani et al. | |
| 7,270,449 | B2 | 9/2007 | Uke | |
| 7,470,042 | B2 | 12/2008 | Ayabe et al. | |
| 7,568,821 | B2 | 8/2009 | Peck et al. | |
| 7,578,600 | B2 | 8/2009 | Czajkowski | |
| 7,585,096 | B2 | 9/2009 | Fallahi et al. | |
| 7,597,465 | B2 | 10/2009 | Inaba et al. | |
| 7,604,384 | B2 | 10/2009 | Peck | |
| 7,658,513 | B2 | 2/2010 | Peck | |
| 7,794,119 | B2 * | 9/2010 | Venhaus | 362/346 |
| 2005/0094393 | A1 | 5/2005 | Czajkowski | |
| 2005/0157490 | A1 | 7/2005 | Kiose | |
| 2005/0213336 | A1 | 9/2005 | Ford et al. | |
| 2006/0044808 | A1 | 3/2006 | Gorres | |
| 2006/0087860 | A1 | 4/2006 | Ishida | |
| 2006/0209270 | A1 | 9/2006 | Suzuki | |
| 2007/0247856 | A1 | 10/2007 | Wang et al. | |
| 2009/0034271 | A1 | 2/2009 | Gorres et al. | |
| 2009/0034272 | A1 | 2/2009 | Gorres et al. | |
| 2009/0067172 | A1 | 3/2009 | Inoue et al. | |

FOREIGN PATENT DOCUMENTS

| | | |
|---|---|---|
| JP | 19080565 A | 3/2007 |
| WO | 98/17944 | 4/1998 |
| WO | 2005/036054 | 4/2005 |

OTHER PUBLICATIONS

Translated Chinese Office Action issued Apr. 13, 2011 for Chinese Application No. 200880022065.9 corresponding to U.S. Appl. No. 12/115,020, 12 pages.

Fig. 2.1 Plan Review of Roadway Coverage for Different Types of Luminaries, Oct. 16, 2007, Retrieved from the Iowa Statewide Urban Design and Specifications Web site, Chapter 11, Section 2, p. 11: http://www.iowasudas.org/documents/Ch11Sect2-07.pdf.

International Search Report and Written Opinion for corresponding International Application No. PCT/US2008/062614 mailed on Oct. 16, 2008.

* cited by examiner

| REFLECTOR SECTION | FOCAL LENGTH |
|---|---|
| 1 | 13.5MM |
| 2 | 14.0MM |
| 3 | 15.1MM |
| 4 | 16.0MM |
| 5 | 16.5MM |
| 6 | 17.0MM |
| 7 | 17.8MM |
| 8 | 19.0MM |
| 9 | 20.0MM |
| 10 | 22.0MM |
| 11 | 23.0MM |

SOLID STATE OPTICAL SYSTEM

RELATED APPLICATION DATA

This application is a continuation-in-part of co-pending U.S. patent application Ser. No. 12/115,020 filed Mar. 5, 2008, which claims benefit under 35 U.S.C. Section 119(e) of co-pending U.S. Provisional Application No. 60/927,953, filed May 7, 2007, both of which are fully incorporated herein by reference.

BACKGROUND

The present invention relates to solid state area lighting, such as light emitting diode (LED) area lighting. Recent developments in LED technology have made practical the migration from simple indicator lights, portable device backlights and other low power lighting applications to high power applications including general illumination such as pathway and street lighting applications. The unique radiation profiles of LED's along with their relatively low light output as compared to other high power light sources (arc lamps, etc) requires the use of special optics to make their application effective. Additionally, LED's require special thermal management techniques as the semiconductor junction must remain below a certain temperature to yield long life. Currently high power LED's are mounted to a variety of substrates, most commonly metal core printed circuit boards (MCPCB) that allow an efficient thermal interface to various forms of heat sinks.

SUMMARY

In one aspect the invention provides a light fixture including a housing. The light fixture includes a solid state light emitter coupled to the housing and configured to emit light in a path, the solid state light emitter including a first light-emitting portion configured to emit a first portion of the light and a second light-emitting portion configured to emit a second portion of the light. The light fixture also includes a reflector having a first reflective surface positioned in the path of the light emitted by the solid state light emitter, the first reflective surface including a first substantially parabolic section configured to reflect the first portion of the light, the first substantially parabolic section having a first focal point and a first focal length, and a second substantially parabolic section adjacent the first substantially parabolic section and configured to reflect the second portion of the light, the second substantially parabolic section having a second focal length greater than the first focal length and a second focal point. The light fixture also includes a stray light reflector having a second reflective surface facing the first reflective surface. The first reflective surface reflects a part of the light toward the stray light reflector, and the stray light reflector is configured to reflect the part of the light.

In another aspect, the invention provides a light fixture including a housing. The light fixture includes a solid state light emitter coupled to the housing and configured to emit light in a path, the solid state light emitter including a first light-emitting portion configured to emit a first portion of the light, a second light-emitting portion configured to emit a second portion of the light, and a reflector having a reflective surface positioned in the path of the light emitted by the solid state light emitter, at least a portion of the reflective surface having a longitudinal axis extending in a longitudinal direction. The reflective surface includes a first substantially parabolic section configured to reflect the first portion of the light, the first substantially parabolic section having a first focal point and a first focal length and a second substantially parabolic section adjacent the first substantially parabolic section and configured to reflect the second portion of the light, the second substantially parabolic section having a second focal length greater than the first focal length and a second focal point. The solid state light emitter includes an axis of maximum intensity oriented to be oblique to the longitudinal axis of the reflective surface.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
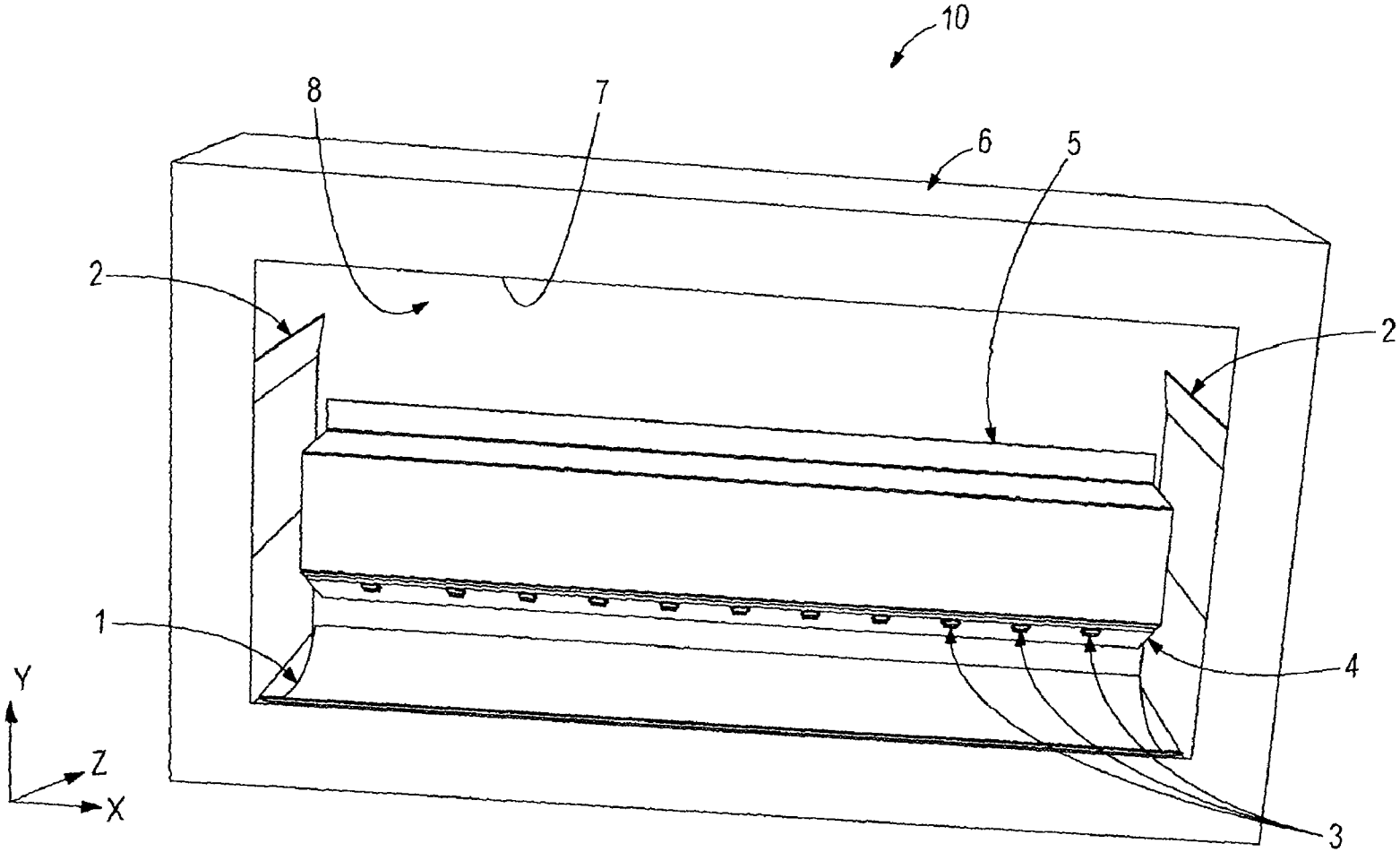
FIG. 1 is a perspective view of the light fixture.

FIG. 1 illustrates one construction of a light fixture including a primary reflector 1, a pair of secondary reflectors 2, and a plurality of solid state light emitters 3 coupled to a housing 6 and configured to reflect light emitted by the plurality of solid state light emitters 3. Emitters 3 preferably emit white light, but other colors may be used.

The plurality of solid state light emitters 3 may include any type of solid state light emitter, such as, but not limited to, single or multi die light emitting diodes (LEDs) and other semiconductor light emitting devices. In the illustrated construction, the plurality of solid state light emitters 3 are positioned in a linear array parallel to the length of the primary reflector 1 and positioned to direct at least a portion of light toward the primary reflector 1. Preferably, the majority of light emitted by the plurality of solid state light emitters 3 is directed toward the primary reflector 1. The plurality of solid state light emitters 3 are mounted to a printed circuit board (PCB) 4, which in turn is mounted to a heat sink 5 mounted to the housing 6. Preferably, the PCB 4 is a metal core PCB to facilitate the transfer of heat from the plurality of solid state light emitters 3 to the PCB 4 to the heat sink 5, although any PCB may be used. The housing 6 also preferably includes a thermally conductive material to facilitate the transfer of heat from the heat sink to the atmosphere. The housing 6 includes an aperture 7 through which light emitted by the plurality of solid state light emitters 3 escapes. The aperture 7 at least defines an output plane 8, shown in FIG. 1 as the x-y plane according to the axes drawn. The output plane 8 is a plane through which light exits the light fixture 10. Preferably, the output plane 8 is configured to be substantially parallel to a target surface 21 (shown in FIG. 10). Of course, it is not necessary that the output plane 8 is parallel to the target surface. The aperture 7 may be left open or may be covered by a lens made of plastic, glass or other suitable substantially transparent material. Alternatively, a lens that modifies the light output may be employed. Optionally, the housing 6 may include drive electronics (not shown) to control the plurality of solid state light emitters 3. In other constructions, the plurality of solid state light emitters 3 may include any quantity of solid state emitters or only one single solid state emitter, preferably, but not necessarily, centered with respect to the length of the primary reflector 1.

The primary reflector 1 includes a reflective finish, such as vacuum metalized aluminum or silver, and may be specular, semi-specular, or diffuse, or a combination thereof. The structure of the primary reflector 1 will be described in greater detail below. The pair of secondary reflectors 2 includes a reflective finish, such as vacuum metalized aluminum or silver, and may be specular, semi-specular, or diffuse, or a combination thereof. The pair of secondary reflectors 2 are positioned adjacent each lengthwise end of the primary reflector 1, and substantially normal to the primary reflector 1, such that the reflective finish of the secondary reflectors 2 is positioned to intercept light reflected off the primary reflector 1 that does not immediately exit the housing 6 by way of aperture 7 to redirect this light toward the aperture 7. Additionally, light emitted by the outermost of the plurality of solid state emitters 3 may intersect the secondary reflectors 2 directly. The secondary reflectors 2 are positioned to redirect this light toward the aperture 7. Light intersecting the secondary reflectors 2 may be aimed by rotating the secondary reflectors, altering their shape, or a combination of the two.

Figure 2:
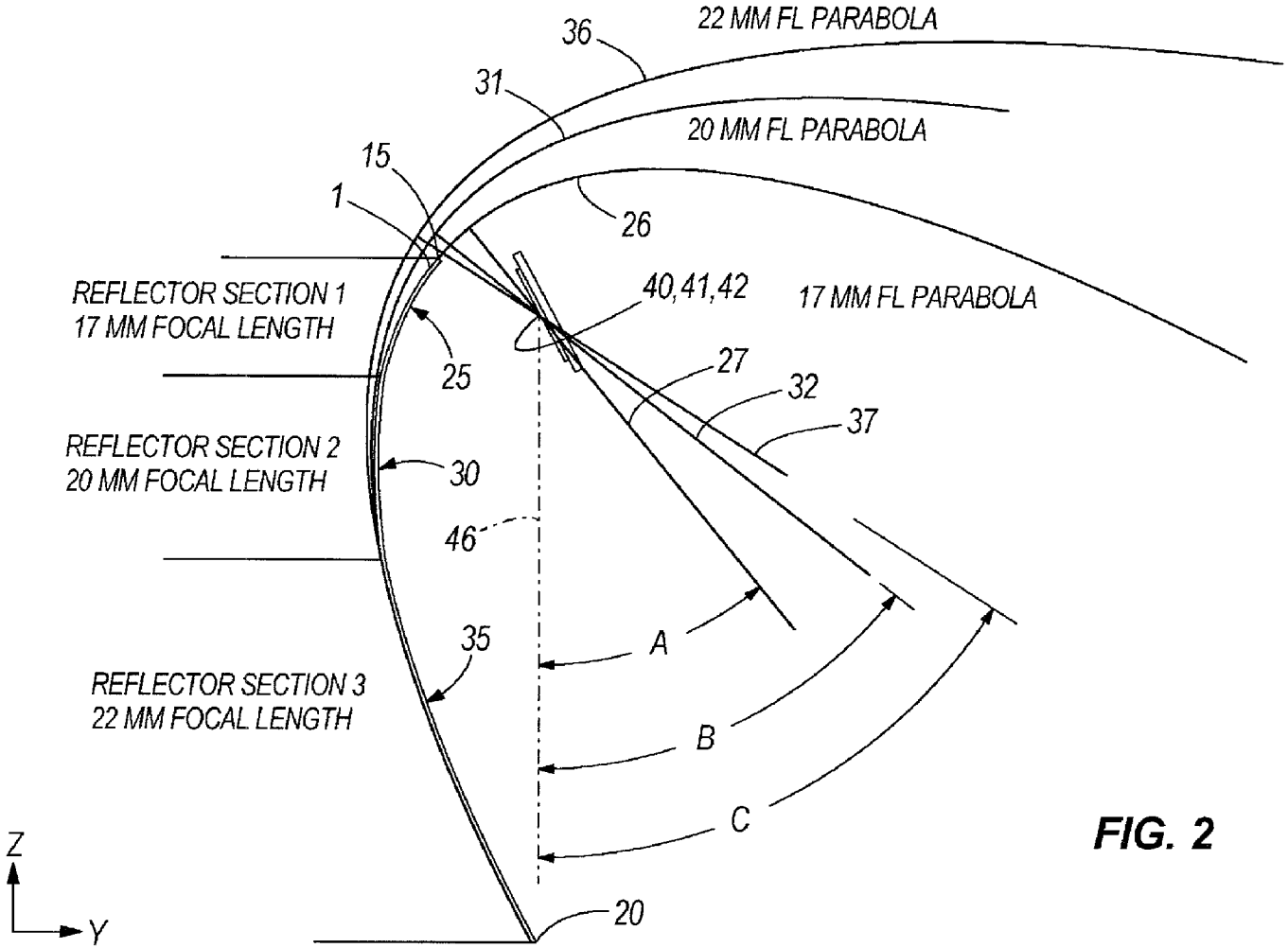
FIG. 2 is a cross section of the primary reflector of FIG. 1

FIG. 2 illustrates a cross section of the primary reflector 1. The primary reflector 1 includes a first parabolic section 25 adjacent the first end 15, a second parabolic section 30, and a third parabolic section 35 adjacent the second end 20. In other constructions, only two parabolic sections may be employed, and in other constructions still, more than three parabolic sections may be employed, as will be described in greater detail later.

The first parabolic section 25 includes a portion of a first parabola 26 having a first focal point 40 and a first focal length. In the illustrated construction, the first parabola 26 has a first focal length of approximately 17 mm; however, the first focal length may be varied to achieve other curvatures.

The second parabolic section 30 includes a portion of a second parabola 31 having a second focal point 41, substantially coincident with the first focal point 40, and a second focal length greater than the first focal length. In the illustrated construction, the second parabola 31 has a second focal length of approximately 20 mm; however, the second focal length may be varied to achieve other curvatures.

The third parabolic section 35 includes a portion of a third parabola 36 having a third focal point 42, substantially coincident with the first focal point 40 and the second focal point 41, and a third focal length greater than the second focal length. In the illustrated construction, the third parabola 36 has a third focal length of approximately 22 mm; however, the third focal length may be varied to achieve other curvatures. Alternatively, a straight or arcuate third section may be employed.

The first parabolic section 25 is nearest the first focal point 40, the second parabolic section 30 is generally farther from the first focal point 40, and the third parabolic section 35 is farther still from the first focal point 40. The parabolic sections 25, 30, and 35 are merged smoothly together or positioned adjacent to each other. Each parabolic section 25, 30, and 35 may also be approximated by a plurality of flat or arcuate sections, as will be described in greater detail later. In the illustrated construction, a first centerline 27 which is an axis of symmetry passing through the first focal point 40 of the first parabola 26 is oriented at a first angle A with respect to a substantially vertical reference line 46 (z-direction, normal to the output plane 8), a second centerline 32 which is an axis of symmetry passing through the second focal point 41 of the second parabola 31 is oriented at a second angle B with respect to the substantially vertical reference line 46, and a third centerline 37 which is an axis of symmetry passing through the third focal point 42 of the third parabola 36 is oriented at a third angle C with respect to the substantially vertical reference line 46. In the illustrated configuration, angle A is approximately 39 degrees, angle B is approximately 52 degrees, and angle C is approximately 57 degrees. However, it is to be understood that by varying the angles A, B and C, different patterns of illuminance can be achieved on a target surface. The reflector geometry illustrated in FIG. 2 may be varied to achieve various desired results; however the strategy of positioning at least two parabolas having different focal lengths adjacent each other remains the same. It is to be understood that focal length, angle with respect to a reference line, and scale of each parabolic section may be varied to achieve a desired output pattern of light. Additionally, it is not necessary that all focal points be coincident. The parabolic sections may be merged, or positioned adjacent each other, without merging each focal point. However, positioning each focal point at or near a common focal point is preferable.

The primary reflector 1 can be made by injection molding or extruding a material, such as aluminum, that can then be made reflective by vacuum metalizing, polishing, or a similar process. Preferably, a highly reflective semi-specular material is employed.

Figures 3, 4:
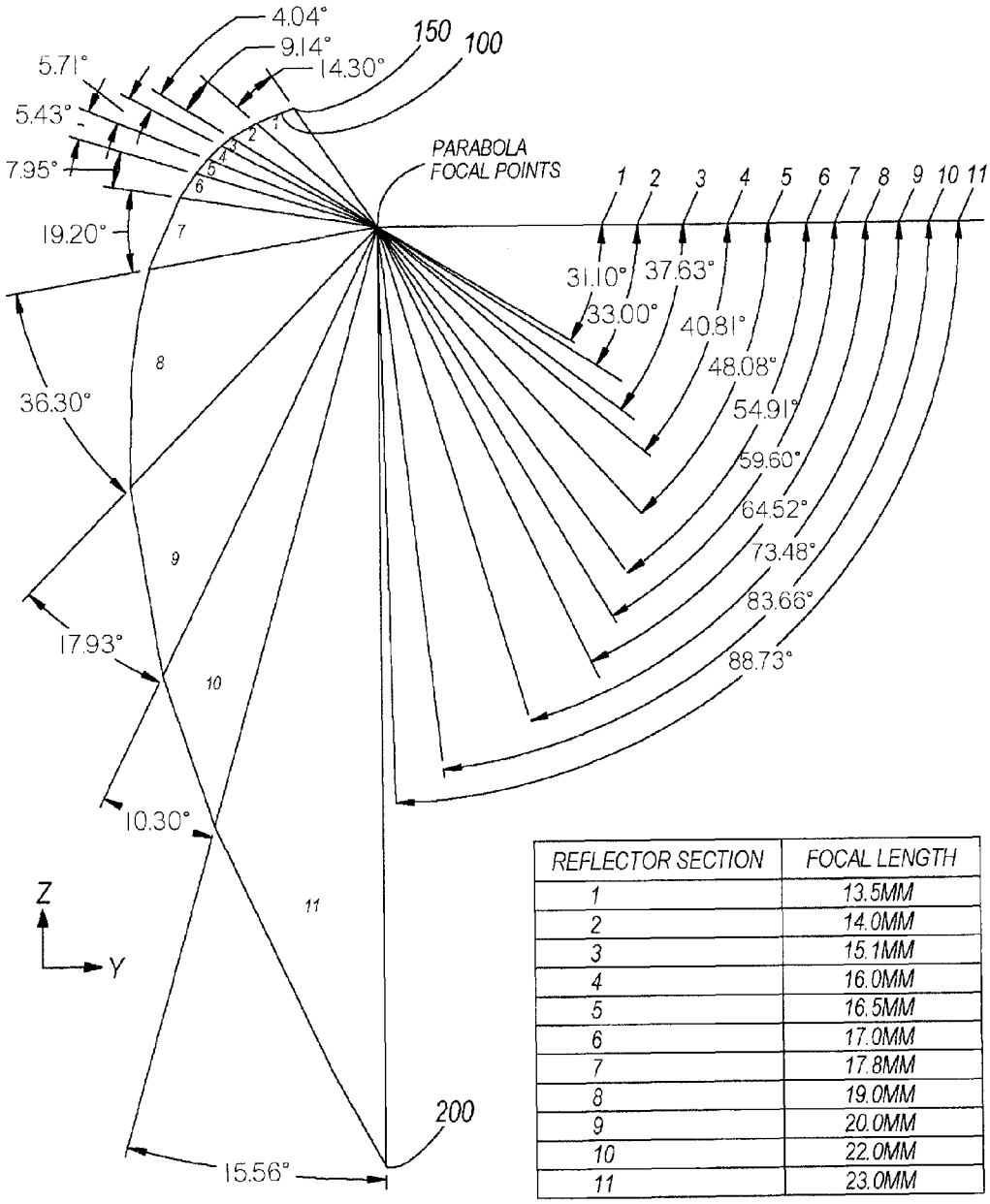
FIG. 3 is a cross section of a second construction of the primary reflector.
FIG. 4 is a table showing focal lengths of sections of the primary reflector of FIG. 3.

FIGS. 3 and 4 illustrate a cross section view of another construction of a primary reflector 100 having eleven parabolic sections, each parabolic section having a respective focal point and a respective focal length. As described above with respect to FIG. 2, each parabolic section, beginning at a first end 150 and ending at a second end 200, has an increasing focal length and is merged smoothly or positioned adjacent to other parabolic sections. The values of the focal lengths of each section are given in FIG. 4. Alternatively, the parabolic sections may be approximated by a plurality of straight or arcuate sections. Preferably, each focal point is positioned at or near a common focal point; however, this is optional.

Figure 5:
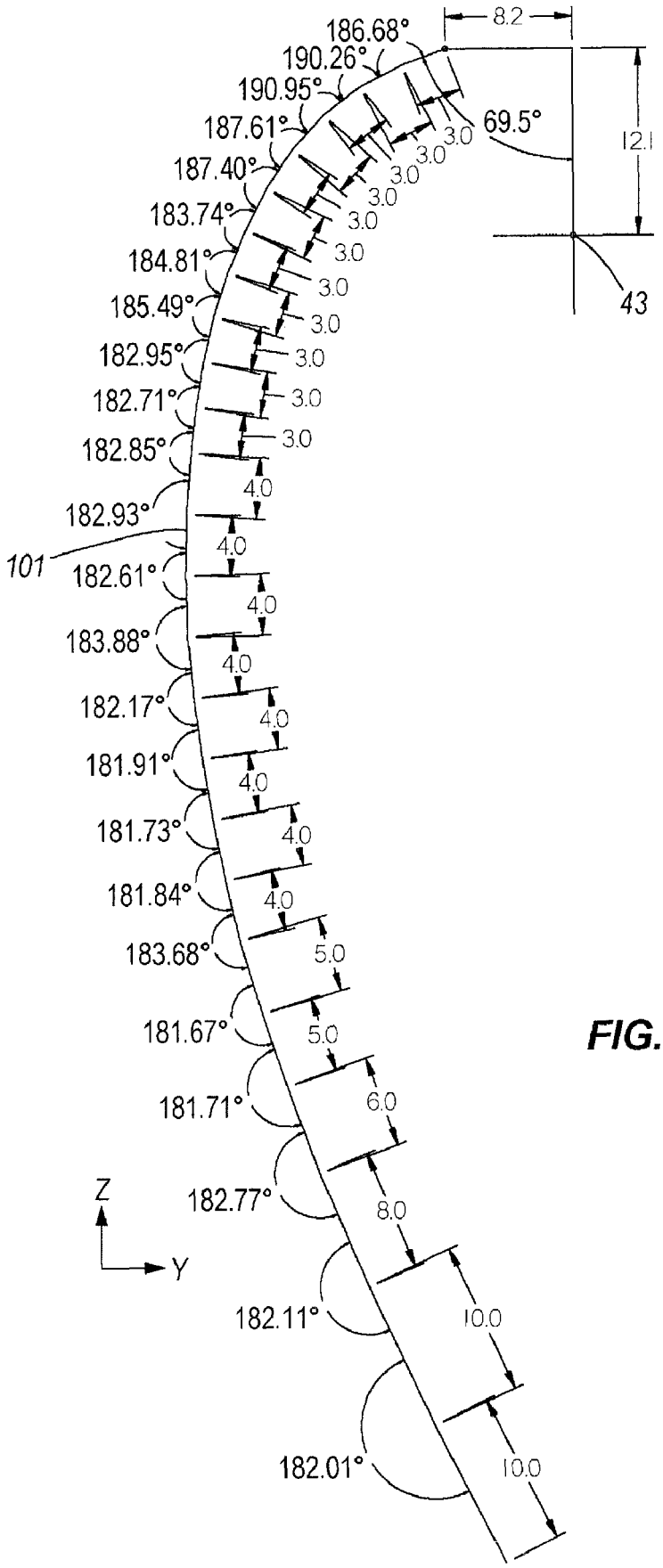
FIG. 5 is a cross section of a third construction of the primary reflector.

FIG. 5 illustrates a cross section of the primary reflector 100 approximated by a plurality of substantially straight sections, as was described above with respect to FIG. 2. Reference is made to numeral 101 when describing the illustrated approximation of the primary reflector 100. Twenty-five substantially straight sections are shown; however, more or fewer substantially straight sections may be used. Using this approximation, or another approximation using a different number of substantially straight sections, the primary reflector 101 can be made by bending a sheet of high reflective material. The highly reflective material may be selected from a number of suitable highly reflective materials, such as those available from Alanod and ACA Industries, although others also exist. Preferably, a highly reflective semi-specular material is employed. The primary reflector 101 having substantially flat sections may also be injection molded or extruded, as described above with reference to the primary reflector 1. Alternatively, the substantially straight sections may be given a small curvature to create diffusion, in which case the primary reflector 101 preferably employs a highly reflective fully specular material.

Figure 6:
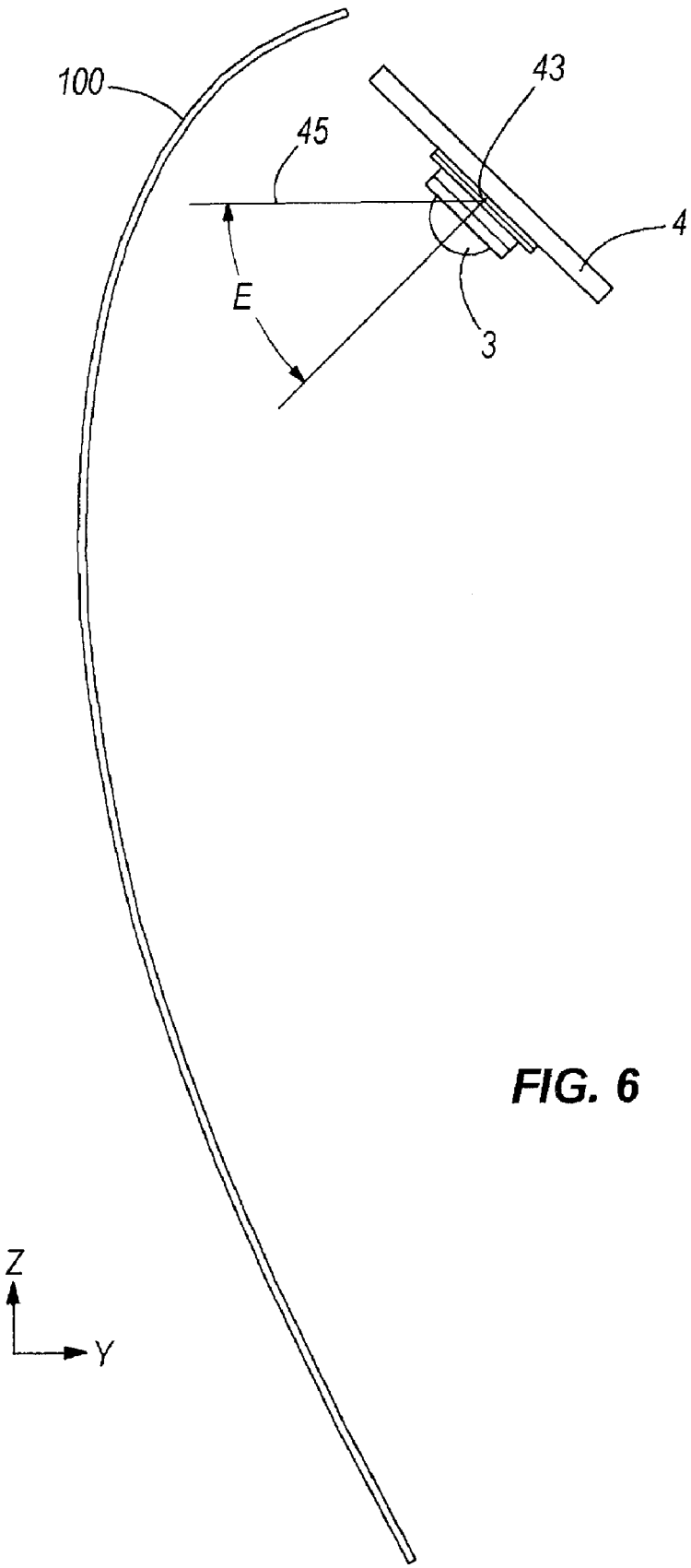
FIG. 6 is a cross section of the reflector of FIG. 3 positioned relative to the emitter.

FIG. 6 illustrates a cross section of the plurality of solid state emitters 3 and the primary reflector 100. It is to be understood that the description of FIG. 6 applies to all constructions of the primary reflector, including the primary reflector referenced by the numeral 1. The plurality of solid state emitters 3 are located at or near a focal point 43 of the primary reflector 100, as was described above, at an angle E of between 0 and 90 degrees from a reference line 45 and facing the primary reflector 100. The reference line 45 is substantially parallel to the output plane 8 (shown in FIG. 1). Focal point 43 refers to any one of the focal points of the parabolic sections making up the primary reflector 100. As was described above, the focal points need not be coincident. More preferably, the plurality of solid state emitters 3 is located at or near the focal point 43 at an angle E of between approximately 35 and 55 degrees. Most preferably, the plurality of solid state emitters 3 is located at or near the focal point 43 at an angle E of approximately 45 degrees. The larger the angle E, the more light is aimed directly below the light fixture toward the target surface without hitting the primary reflector 100, and the less light is reflected toward other portions of the target surface not directly below the light fixture. The radiation pattern of the type of solid state light emitter(s) used can affect the angle E needed to produce the desired output pattern of light, therefore angle E may be adjusted accordingly.

Figure 8:
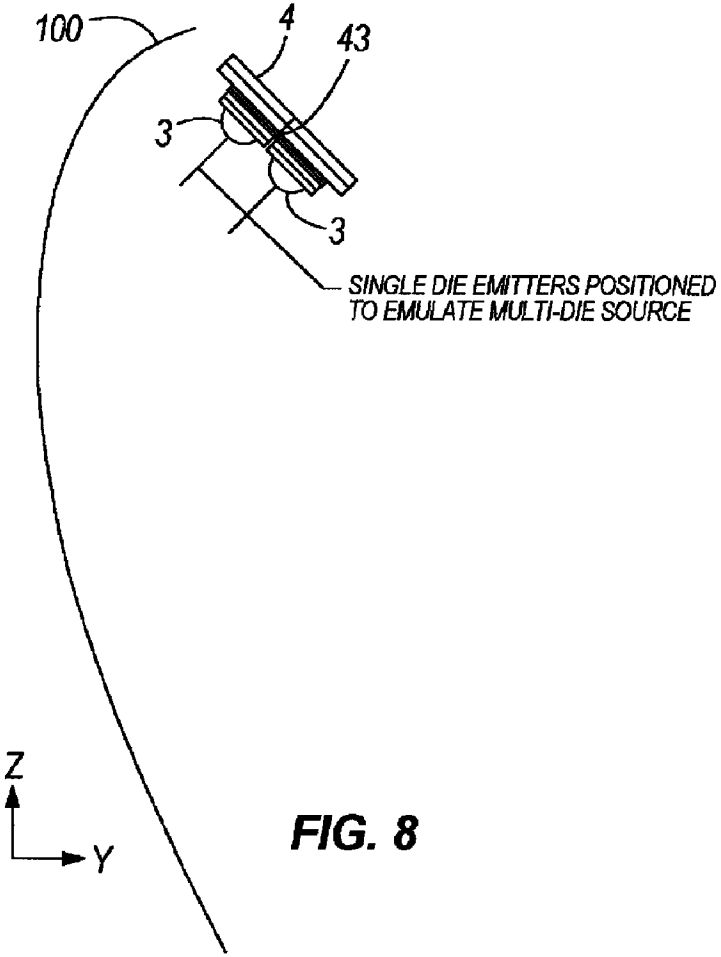
FIG. 8 is a cross section of the reflector of FIG. 3 positioned relative to a third construction of the emitter.
Figure 7:
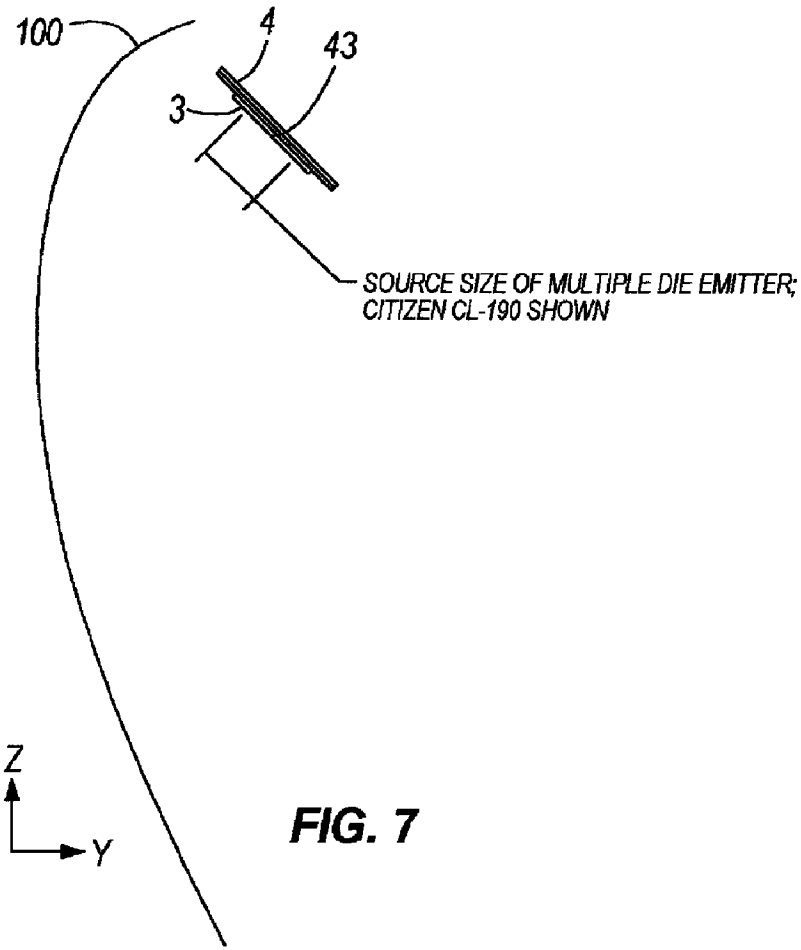
FIG. 7 is a cross section of the reflector of FIG. 3 positioned relative to a second construction of the emitter.

As illustrated in FIGS. 7 and 8, the plurality of solid state emitters 3 may include single die emitters (FIG. 8) or multiple die emitters (FIG. 7). As illustrated in FIG. 8, positioning two or more rows of single die emitters substantially centered about the focal point 43 can be done to emulate a multiple die emitter. A multiple die emitter, or a plurality of single die emitters, have a larger apparent source size which helps to blend the light pattern together when the light reaches a target surface. Multiple die emitters such as, but not limited to, the Citizen LED CL-190 series, Citizen LED CL-230 series, or Nichia 083 series may be employed. Single die emitters such as, but not limited to, the CREE XRE series or Seoul Semiconductor P4 series may be employed.

Figure 9:
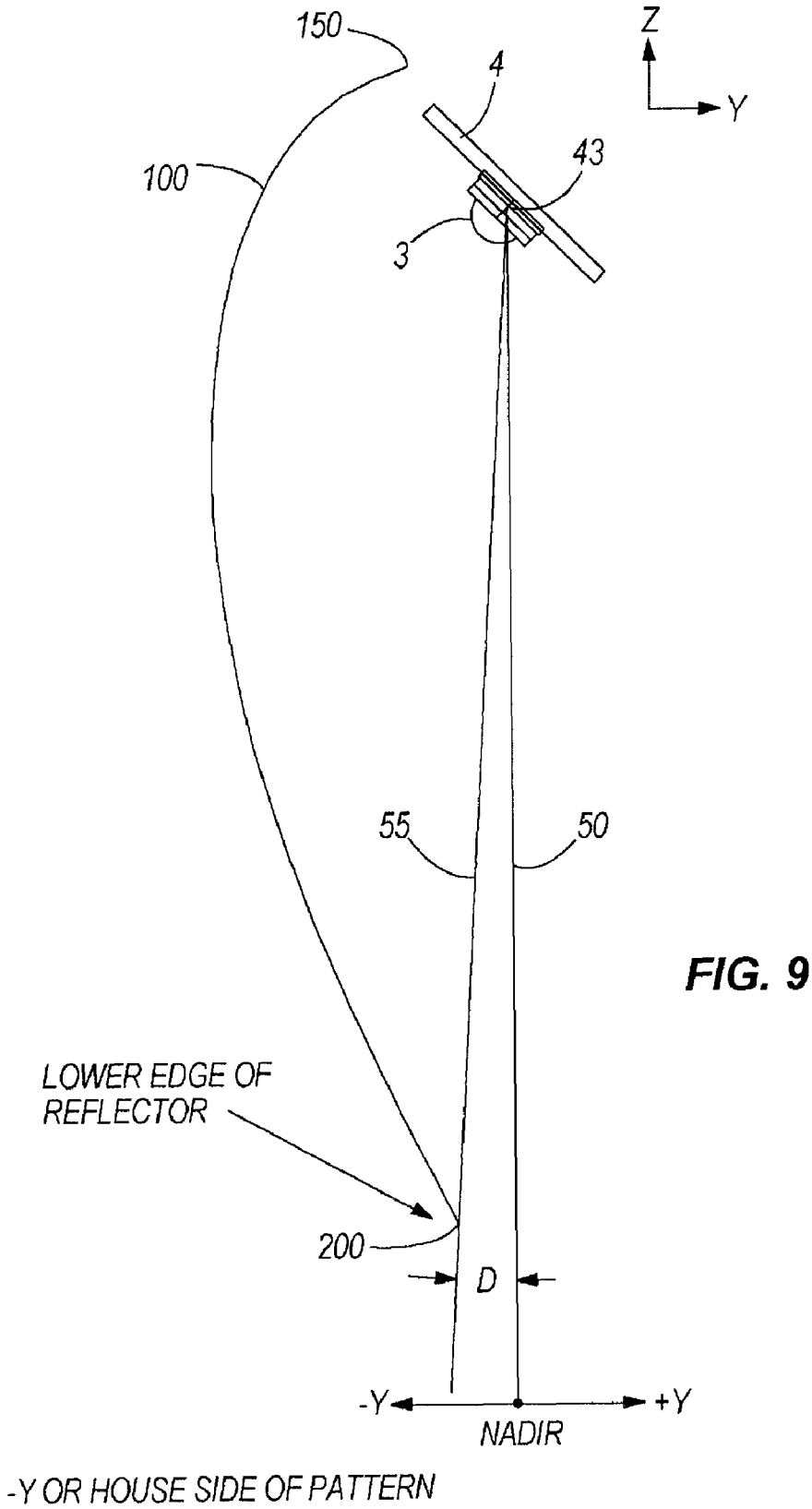
FIG. 9 is a cross section of the reflector of FIG. 3 positioned relative to the emitter.
Figure 10:
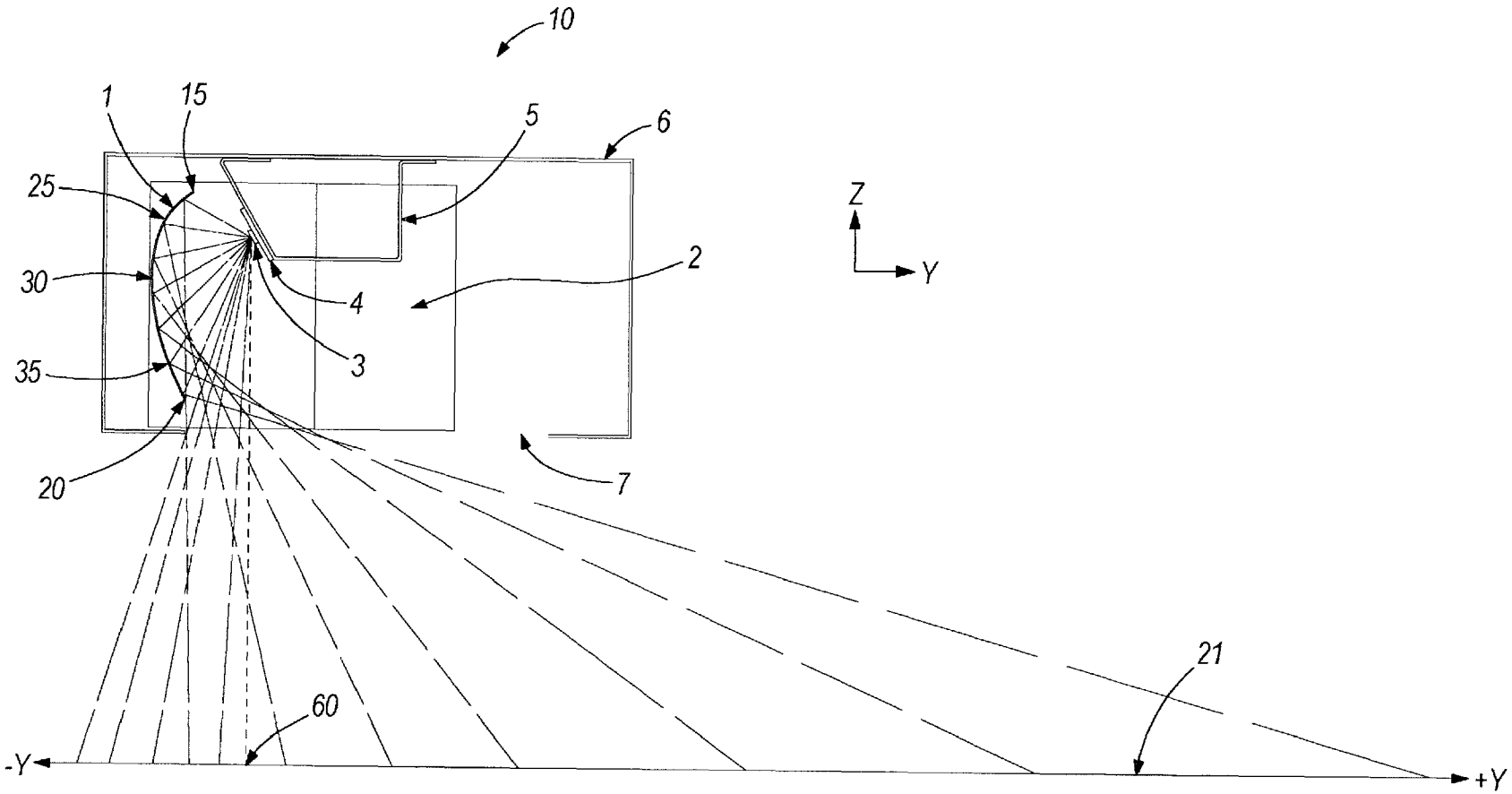
FIG. 10 is a cross section of the light fixture of FIG. 1 showing the distribution of light.

FIG. 9 illustrates one possible construction of the second end 200 of the primary reflector 100 with respect to the plurality of solid state light emitters 3 and a target surface 21 (FIG. 10). The target surface 21 may be any height from the plurality of solid state emitters 3. Line 50 is drawn from the focal point 43, i.e., the location of the plurality of solid state light emitters 3, toward the target surface, perpendicular to the target surface. The line 50 defines positive and negative y-axes, as illustrated. The majority of light reflected by the primary reflector 100 is directed toward the positive y-region. A portion of light emitted by the plurality of solid state light emitters is directed directly toward the target surface, some of which is directed in the negative y-direction and intersects the target surface in the negative y-region, also known as the "house side", without being reflected. This is a result of the geometry of the second end 200 with respect to the plurality of solid state light emitters 3. An angle D is defined as the angle between line 50 and a line 55 drawn from the focal point 43 to the second end 200. It is to be understood that angle D can be varied by moving or rotating the primary reflector 100 with respect to the plurality of solid state light emitters 3, or by trimming the second end 200, depending on how much light is desired on the house side. Preferably, angle D is between 0 to 15 degrees; however, angle D may be as much as 30 degrees or more depending upon the application.

FIG. 10 illustrates a cross section of the light fixture of FIG. 1 and shows the paths of light emitted by the plurality of solid state light emitters 3 and reflected by the primary reflector 1. The particular construction of FIG. 10 is only one example of a possible configuration. It is to be understood that different orientations of the light fixture with respect to the target surface result in different patterns of illumination on the target surface 21. Different orientations may include height above the target surface 21, angle of the primary reflector 1 with respect to the target surface 21, angle of the plurality of solid state light emitters 3 with respect to the target surface 21, and angle of the primary reflector 1 with respect to the plurality of solid state light emitters 1, among others. Also, the geometry of the primary reflector 1 may be varied, as was discussed above, to achieve different results.

Figure 20:
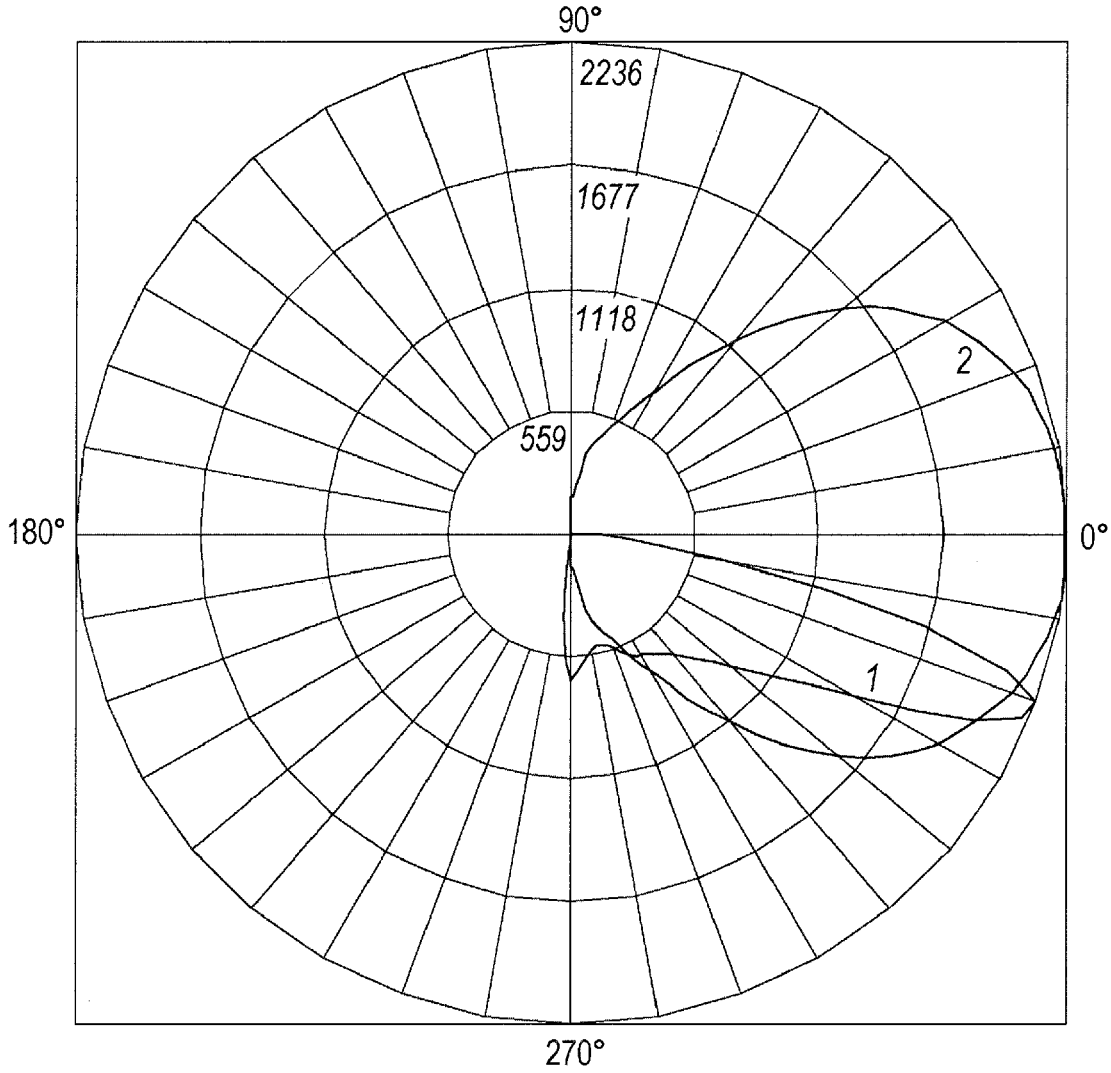
FIG. 20 is a polar candela plot for the output of the light fixture of FIGS. 1 and 10.

With reference to the construction shown in FIG. 10, the first parabolic section 25 is located nearer the plurality of solid state emitters 3 and is configured to reflect light from the plurality of solid state light emitters 3 generally toward nadir 60, which is a portion of the target surface 21 located directly below, or closest to, the solid state light emitter 3. The first parabolic section 25 is configured to distribute light such that incident light has a lower luminous intensity, as illustrated by the polar candela distribution plot between approximately 270 degrees and 300 degrees (FIG. 20, curve 1). The second parabolic section 30 is farther from the plurality of solid state light emitters 3 than the first parabolic section and is configured to reflect light in the positive y-direction farther from nadir 60 than the first parabolic section 25. The second parabolic section 30 is configured to distribute light such that incident light has a higher luminous intensity than that distributed by the first parabolic section 25, as can be seen in curve 1 of FIG. 20 approximately between 300 degrees and 320 degrees. The third parabolic section 35 is farther from the plurality of solid state light emitters 3 than the second parabolic section and is configured to reflect light in the positive y-direction farther from nadir 60 than the first parabolic section 25 and the second parabolic section 30. The third parabolic section 35 is configured to distribute light such that incident light has a higher luminous intensity than that distributed by the second parabolic section 30, as illustrated in curve 1 of FIG. 20 approximately between 320 degrees and 340 degrees, where maximum intensity occurs.

In the case of full or semi cut-off light fixtures, the aperture 7 may attenuate light at angles greater than 80 degrees above nadir. The primary and secondary reflectors may also be repositioned in the housing to facilitate full or semi-cutoff specifications. With further reference to FIG. 10, the plurality of solid state light emitters are configured to direct a portion of light directly toward the target surface, without hitting the primary reflector 1, at or near nadir 60 and toward the house side, as described with reference to FIG. 9. This light intersects the paths of light reflected off of the first, second and third parabolic sections 25, 30, and 35, respectively. The output from each parabolic section 25, 30 and 35 is aimed such that each output blends smoothly to the next output, forming a homogeneous light pattern. It is to be understood that the location of the target surface 21 with respect to the light fixture 10 may vary. As such, the intensity of illumination on the target surface 21 will vary depending upon the distance of the target surface 21.

Figure 11:
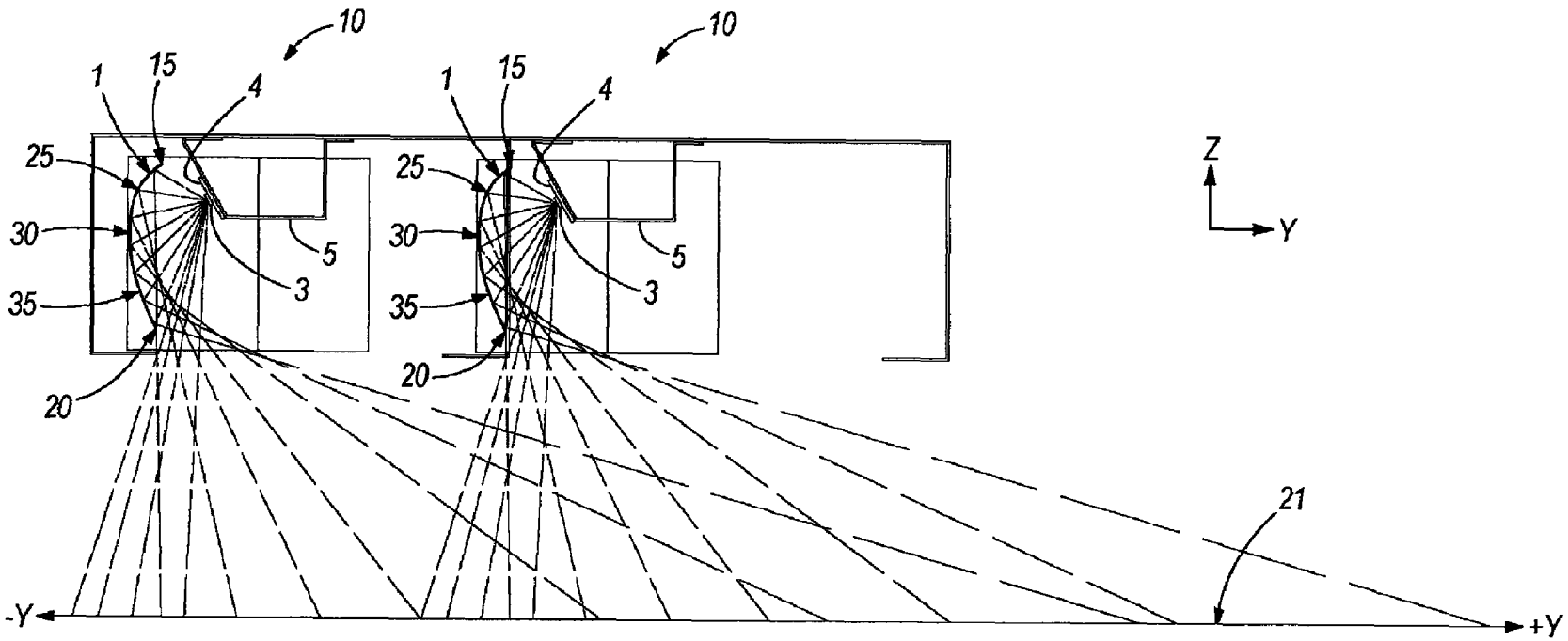
FIG. 11 is a cross section of a second construction of the light fixture showing the distribution of light.
Figure 12:
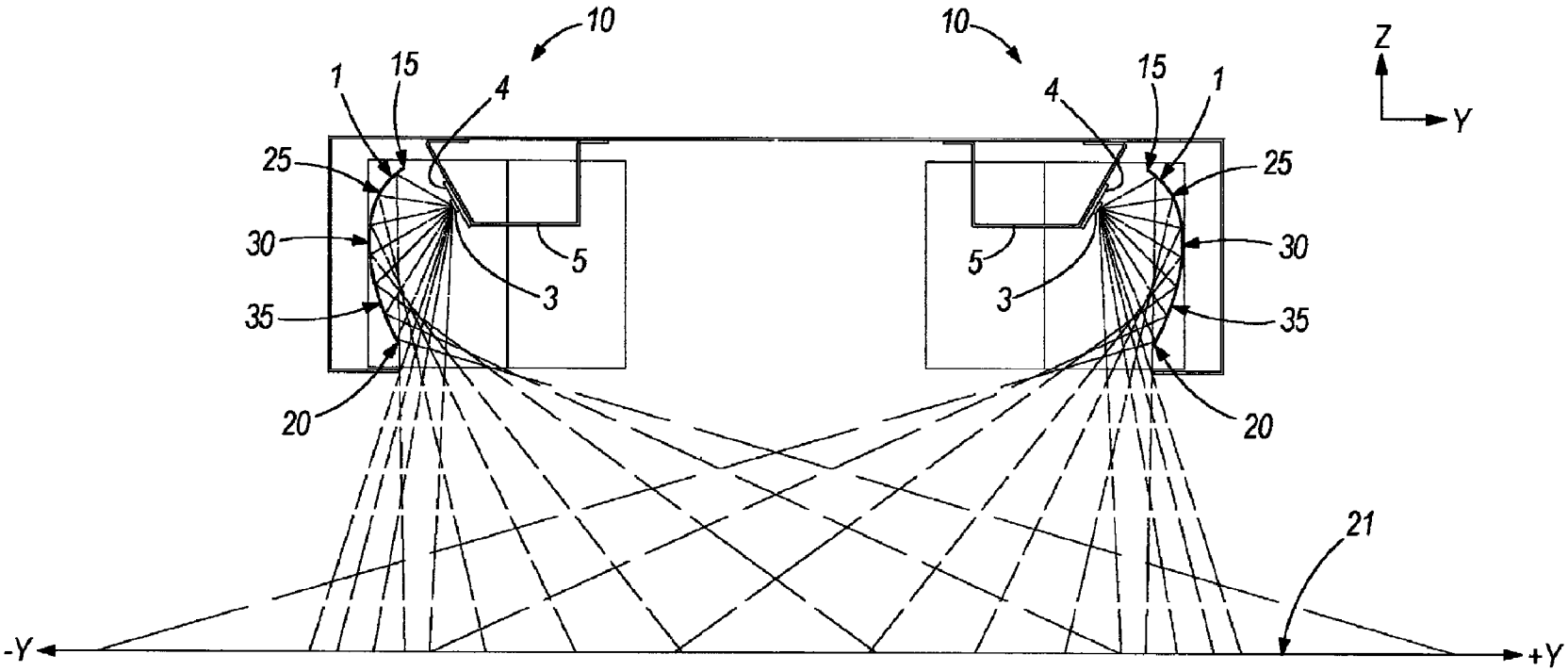
FIG. 12 is a cross section of a third construction of the light fixture showing the distribution of light.

Two or more of the light fixtures 10 may be combined into a single fixture, as shown in FIGS. 11 and 12. Each light fixture 10 may be oriented in the same direction, as illustrated in FIG. 11. Each light fixture 10 may be oriented in the opposite direction, as illustrated in FIG. 12. Furthermore, each light fixture 10 may be normal to another, or positioned in any other configuration that yields a useful photometric output.

Figure 14:
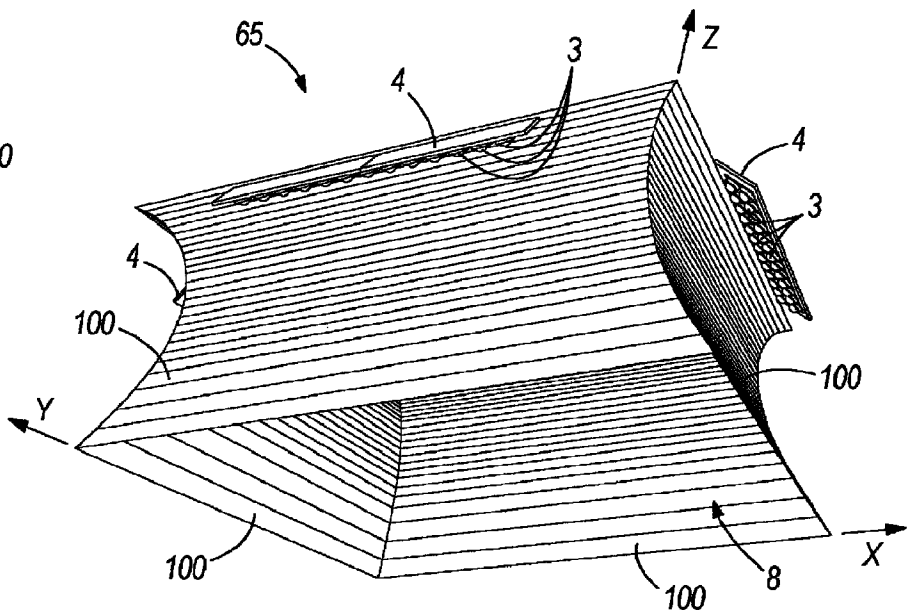
FIG. 14 is a perspective view of the fourth construction of the light fixture.
Figure 15:
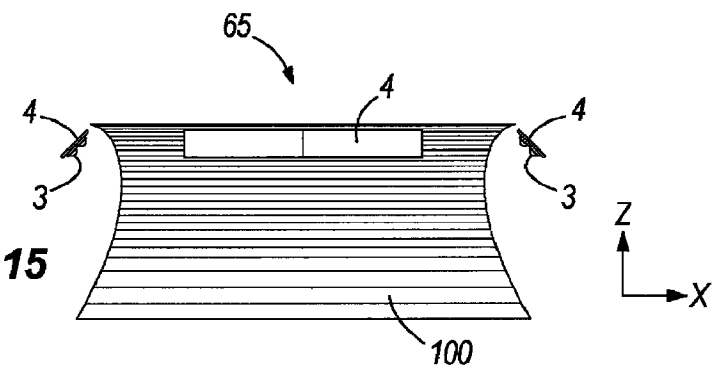
FIG. 15 is a side view of the fourth construction of the light fixture.
Figure 13:
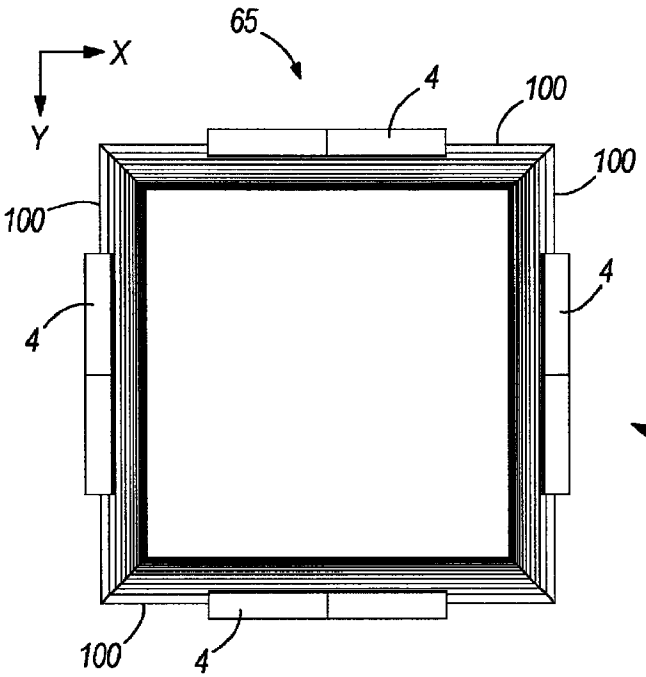
FIG. 13 is a top view of a fourth construction of the light fixture.

FIGS. 13-15 illustrate a construction of a light fixture 65 employing four primary reflectors 100 and four pluralities of solid state light emitters 3. It is to be understood that any other construction of the primary reflector according to the invention, as described above, may be employed. Each primary reflector 100 is oriented and positioned relative to its respective plurality of solid state light emitters 3 as described above. Each plurality of solid state emitters 3 is mounted to a printed circuit board 4, which is in turn mounted to a heat sink (see FIG. 1), which is mounted to a housing (see FIG. 1), as described above. Furthermore, each reflector-emitter pair is adjoined to two other pairs normal to one another to form a box of outwardly-facing primary reflectors 100 having a distance of approximately 250 mm from focal point to focal point of opposed pairs, as illustrated. The pairs need not be adjoined. This construction is configured to be used, preferably, as a low bay garage light mounted 6.5 feet to 8 feet above a target surface. Garage lights typically generate a circular or nearly circular light pattern similar to a IESNA Type V pattern on the target surface. However, other applications may exist.

Figure 17:
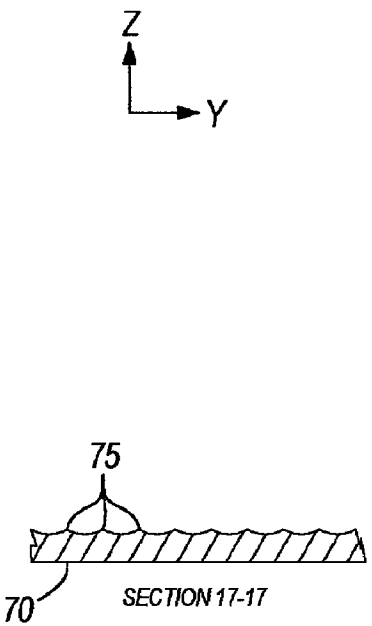
FIG. 17 is a partial cross section of the light fixture of FIG. 16.
Figure 16:
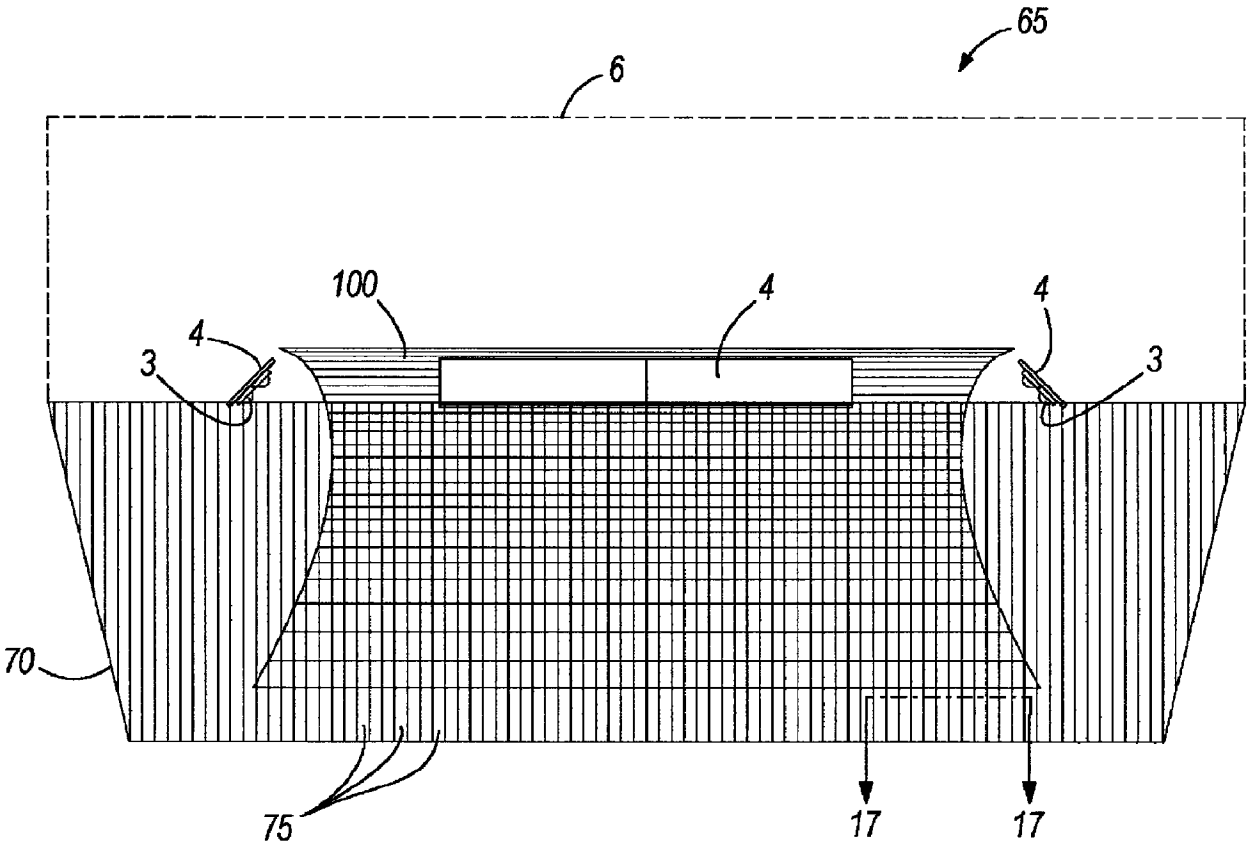
FIG. 16 is a more detailed side view of the fourth construction of the light fixture.

FIG. 16 illustrates the light fixture 65 including a housing 80 and an outer lens 70. As illustrated, the outer lens 70 consists of vertical flutes 75 to provide a limited spread of light in the horizontal direction only and thus reduce glare without disrupting the pattern of illumination on the target surface. FIG. 17 illustrates a cross section of the outer lens 70 having vertical flutes 75. It is to be understood that the outer lens 70 is optional and may be round, square, rectangular, or any other shape, and may contain other optics to modify the light pattern or to reduce glare. Additionally, the bottom, including the output plane 8 (FIG. 1), may also include optics to smoothen the light at or near nadir.

Figure 18:
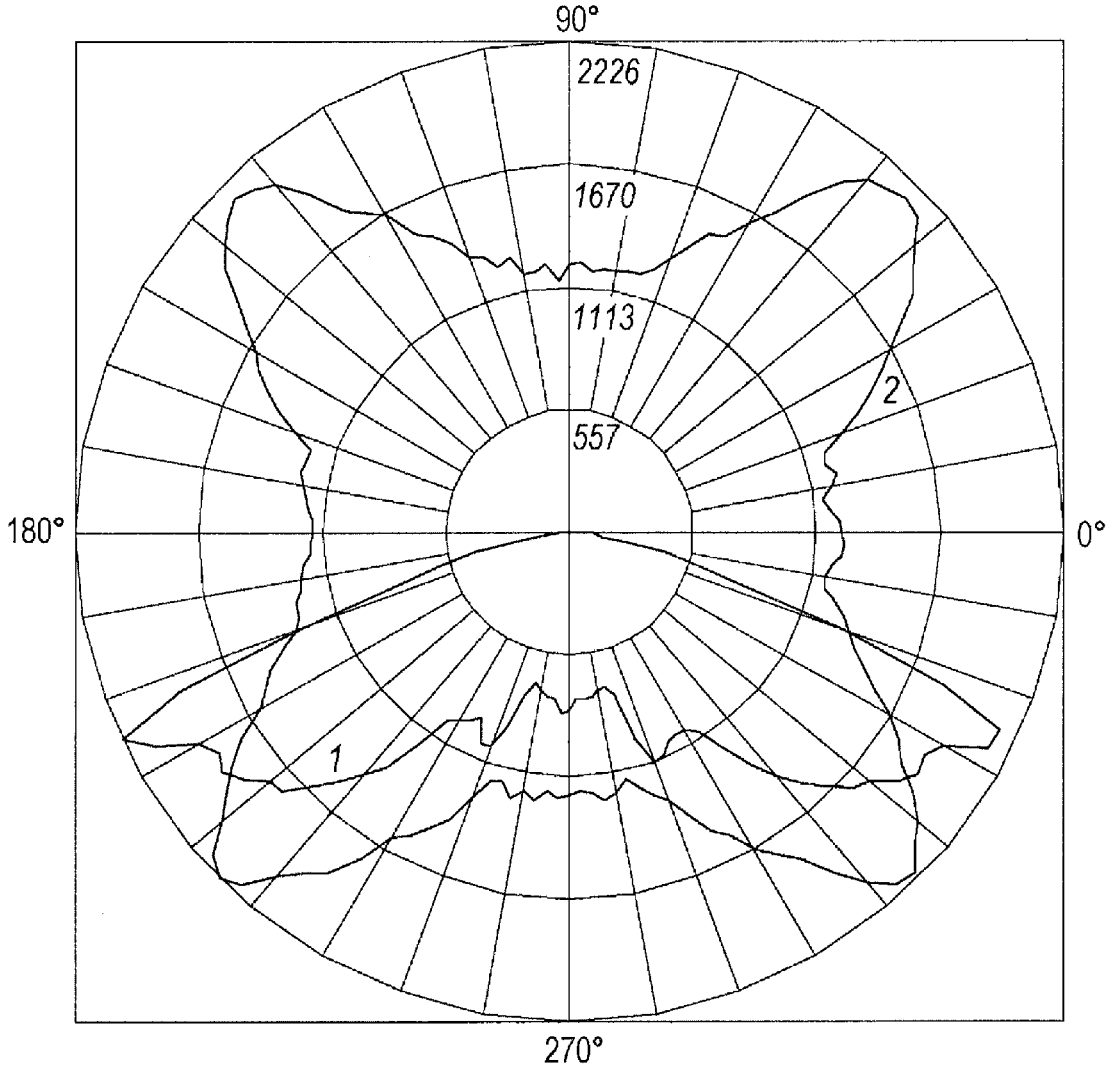
FIG. 18 is a polar candela plot for the output of the light fixture of FIGS. 13-16.
Figure 19:
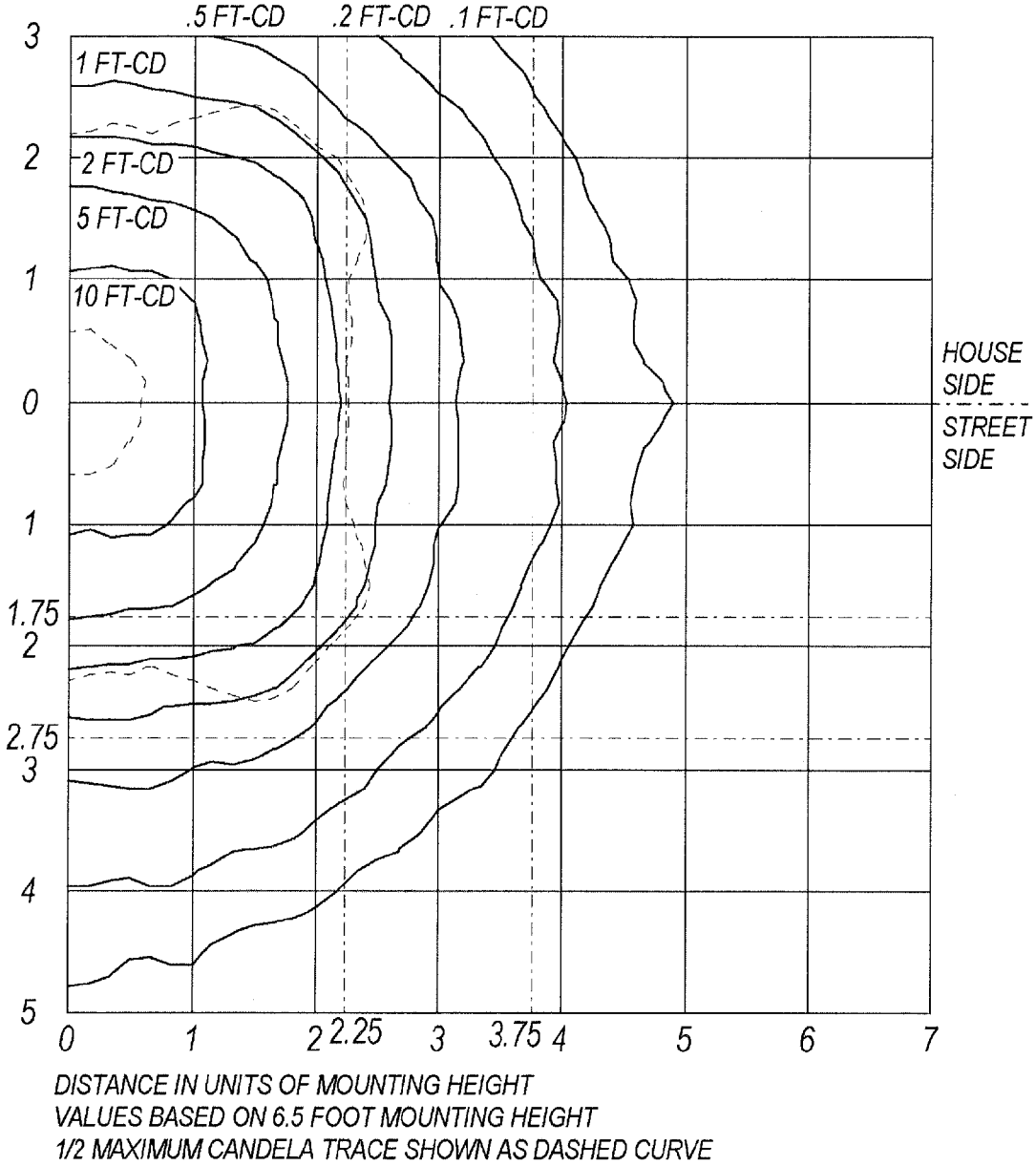
FIG. 19 is a ISO footcandle plot for the output of the light fixture of FIGS. 13-16 for a mounting height of 6.5 feet.

FIG. 18 is a polar candela distribution plot of the output of the light fixture 65 illustrated in FIGS. 13-15. Curve 1 is a plot of luminous intensity (candela) with respect to angular space in the x-z plane (FIG. 15). Curve 2 is a plot of luminous intensity (candela) with respect to angular space in the x-y plane (FIG. 13). FIG. 19 is an ISO footcandle (ft-cd) distribution plot of the light fixture 65 illustrated in FIGS. 13-15 having a mounting height of 6.5 feet.

Figure 21:
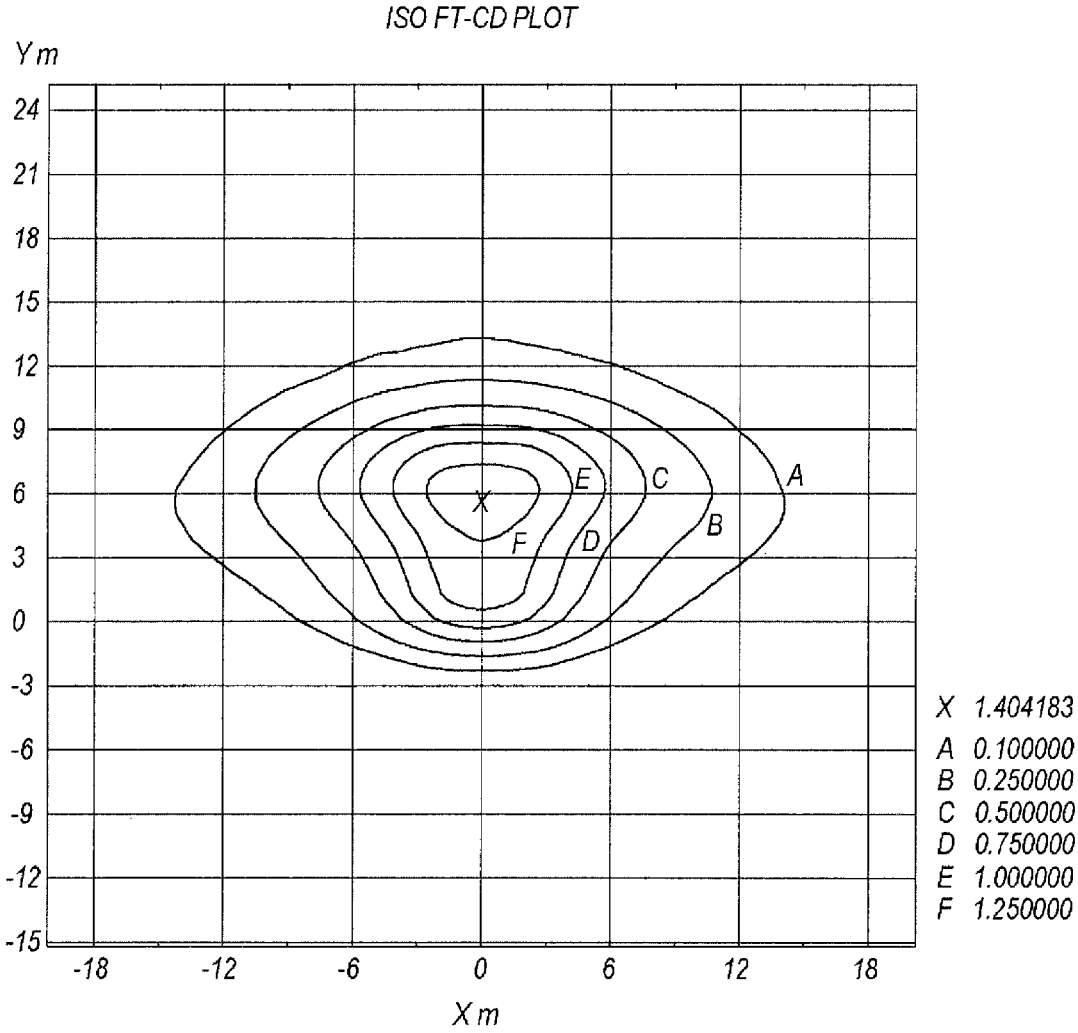
FIG. 21 is a ISO footcandle plot for the output of the light fixture of FIGS. 1 and 10 for a mounting height of 20 ft.

Similarly, FIG. 20 is a polar candela distribution plot of the output of the light fixture 10 illustrated in FIGS. 1 and 10. Curve 1 is a plot of luminous intensity (candela) with respect to angular space in the x-z plane (FIG. 1). Curve 2 is a plot of luminous intensity (candela) with respect to angular space in the x-y plane (FIG. 1). FIG. 21 is an ISO ft-cd distribution plot of the light fixture 10 illustrated in FIGS. 1 and 10 having a mounting height of 20 feet configured for an IESNA Type II street, pathway or parking lot light.

It is to be understood that the primary reflector 1 or 100 may be designed using the technique described above to build reflectors of various sizes and shapes to meet IESNA light patterns for Types I, II, III, IV, and V light fixtures, or to produce other desired light patterns such as for cove lighting, or lighting for ceilings, walls and other areas. The primary reflector 1 or 100 includes substantially parabolic sections which are curved or faceted, as described above, depending on the desired method of fabrication. The primary reflector 1 or 100 may be scaled up or down as desired.

Also, in some cases a small amount of uplight is desirable. Uplight may be obtained by perforating or eliminating a portion of the primary reflector 1 or 100 near the respective first end 15 or 150, and making a portion of the housing transparent, thus allowing a small portion of light to exit the fixture 10 or 65 in the upward (z) direction.

Figure 22:
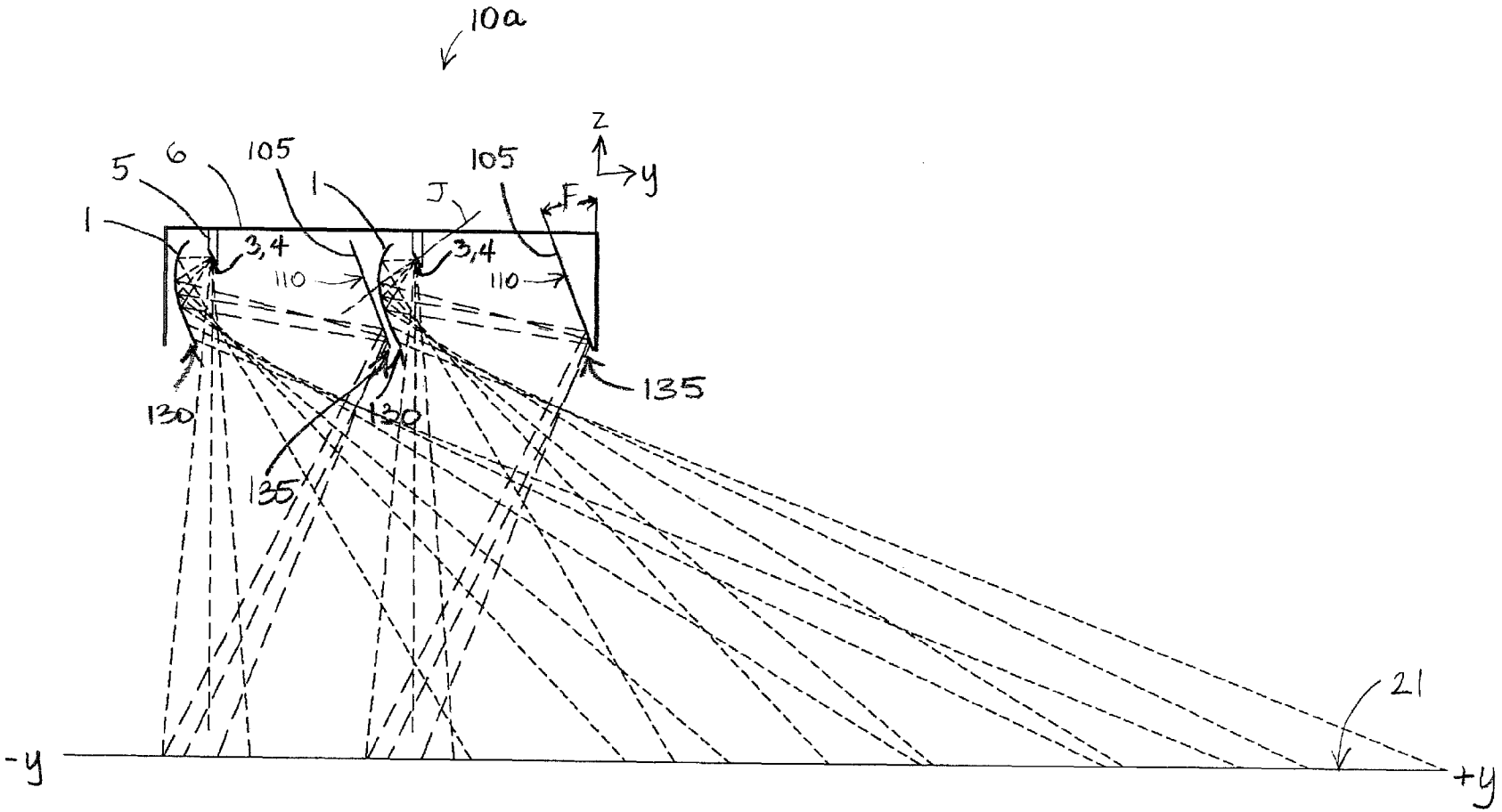
FIG. 22 is a cross section of a light fixture similar to FIG. 11 and having stray light reflectors.
Figure 23:
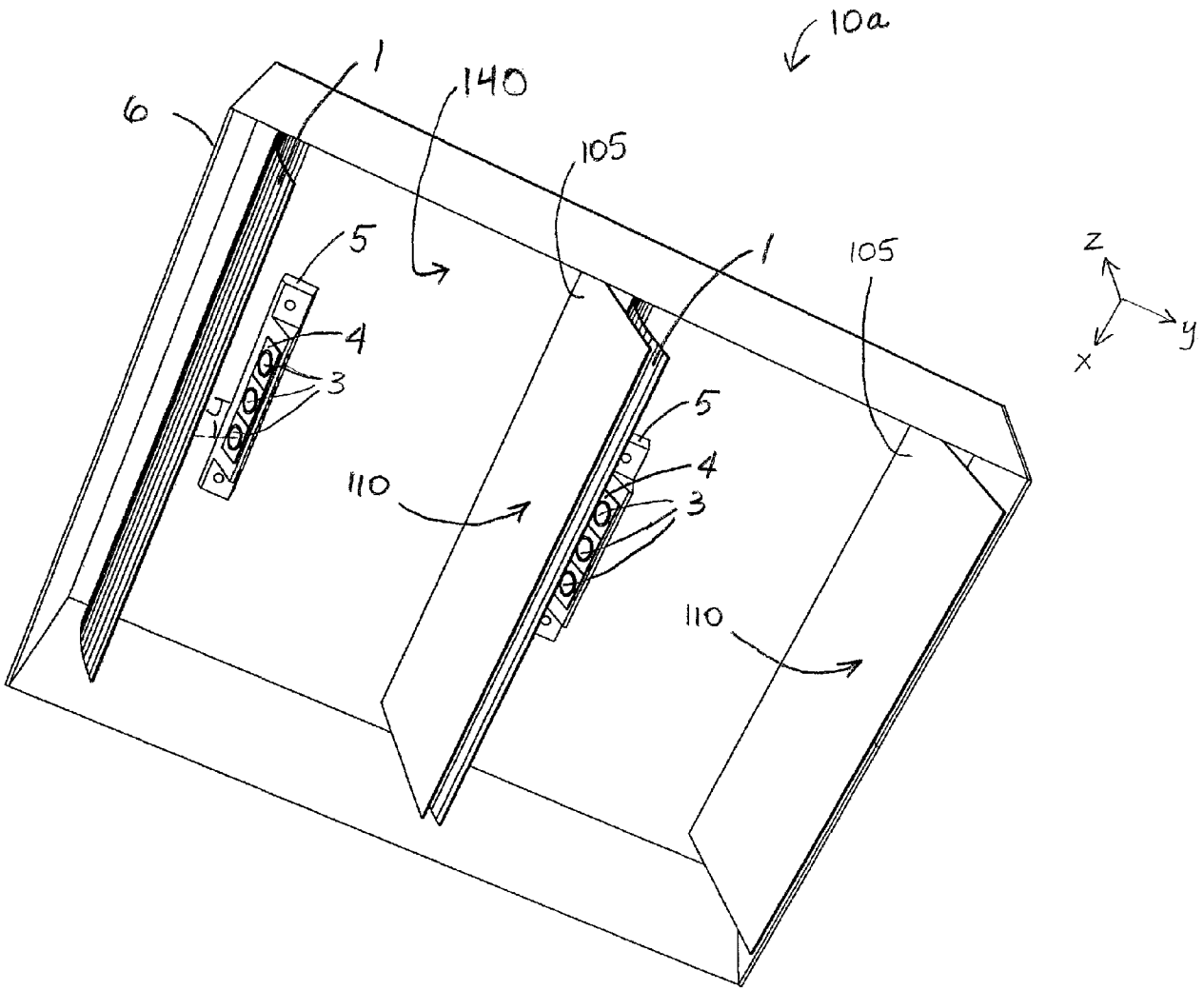
FIG. 23 is a bottom perspective view of the light fixture of FIG. 22 having the stray light reflectors.

FIGS. 22 and 23 illustrate another construction of a light fixture 10*a*, which is similar to the light fixture 10 illustrated in FIG. 11 and further includes a stray light reflector 105 facing the primary reflector 1. In the illustrated construction, the light fixture 10*a* includes two primary reflectors 1 and two stray light reflectors 105. In other constructions, one, three or more primary reflectors 1 may be employed with one, three or more stray light reflectors 105. Similar parts of the light fixture 10*a* are given similar reference numerals and need not be described again. It should be understood that one or more stray light reflectors 105 may be employed with any of the constructions and embodiments described in this application.

As shown in FIG. 22, the stray light reflector 105 reflects stray light, or glare, reflected off the primary reflector 1 at angles that are outside the useful range of angles, e.g., above 80 or 90 degrees from nadir or light that would not otherwise be managed within the light fixture 10*a*. For example, the stray light would otherwise hit the back of another primary reflector 1 or the inside of the light fixture housing 6. As some iterations of the reflector use a semi-specular finish, the amount of light in this non-useful range can be substantial. The stray light reflector 105 redirects the stray light out of the light fixture 10*a* to the target surface 21, and thus improves the optical efficiency of the light fixture.

In the illustrated construction, the stray light reflector 105 is substantially planar or flat and includes a reflective surface 110 facing the reflective surface of the primary reflector 1. In other constructions, the stray light reflector 105 may be curved, faceted, or any combination of flat, curved and faceted. The stray light reflector 105 is preferably the same height, or length in the Z-direction, as the primary reflector 1. In the illustrated construction, the bottom-most portions 130, 135 of the primary reflector 1 and the stray light reflector 105, respectively, are aligned parallel to the target surface 21; however, in other constructions, the stray light reflector 105 could extend below the primary reflector 1 to intercept light from the street side, or positive Y direction, and redirect that light towards the house side in the negative Y direction, depending upon the desired output. The reflective surface 110 of the stray light reflector 105 preferably has a highly reflective finish, most preferably with a reflectivity greater than 85%, and may be specular, semi-specular or diffuse, depending upon the desired output.

The stray light reflector 105 is positioned at an angle F with respect to the Z-axis, or vertical. In the illustrated construction, the angle F is approximately 21 degrees. Depending upon the application, the angle F may be between about 5 and 90 degrees. For example, in applications where the target area for the redirected stray light is the "house side," or negative Y direction, such as for IESNA (Illuminating Engineering Society of North America) Type I, II, III, or IV street lights, the angle F is typically between about 15 and 30 degrees. In applications where the redirected stray light is to be directed in the positive Y direction, such as a parking garage light or IESNA Type V area light, the angle F is typically between about 45 and 90 degrees.

Figures 24A, 24B, 24C, 24D:
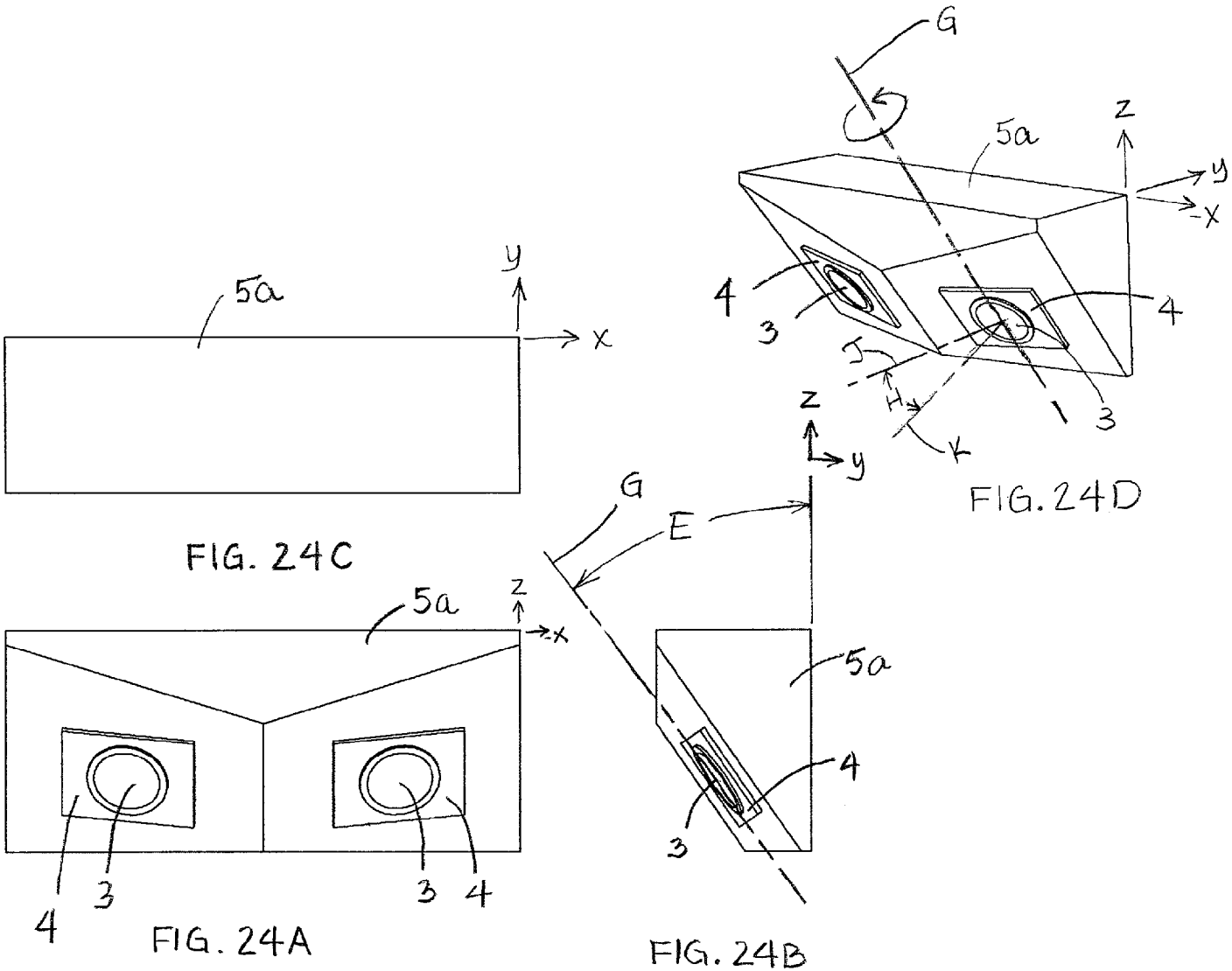
FIG. 24A is a front view of an emitter mounting block.
FIG. 24B is a side view of the emitter mounting block of FIG. 24A.
FIG. 24C is a top view of the emitter mounting block of FIG. 24A.
FIG. 24D is a perspective view of the emitter mounting block of FIG. 24A.
Figure 25:
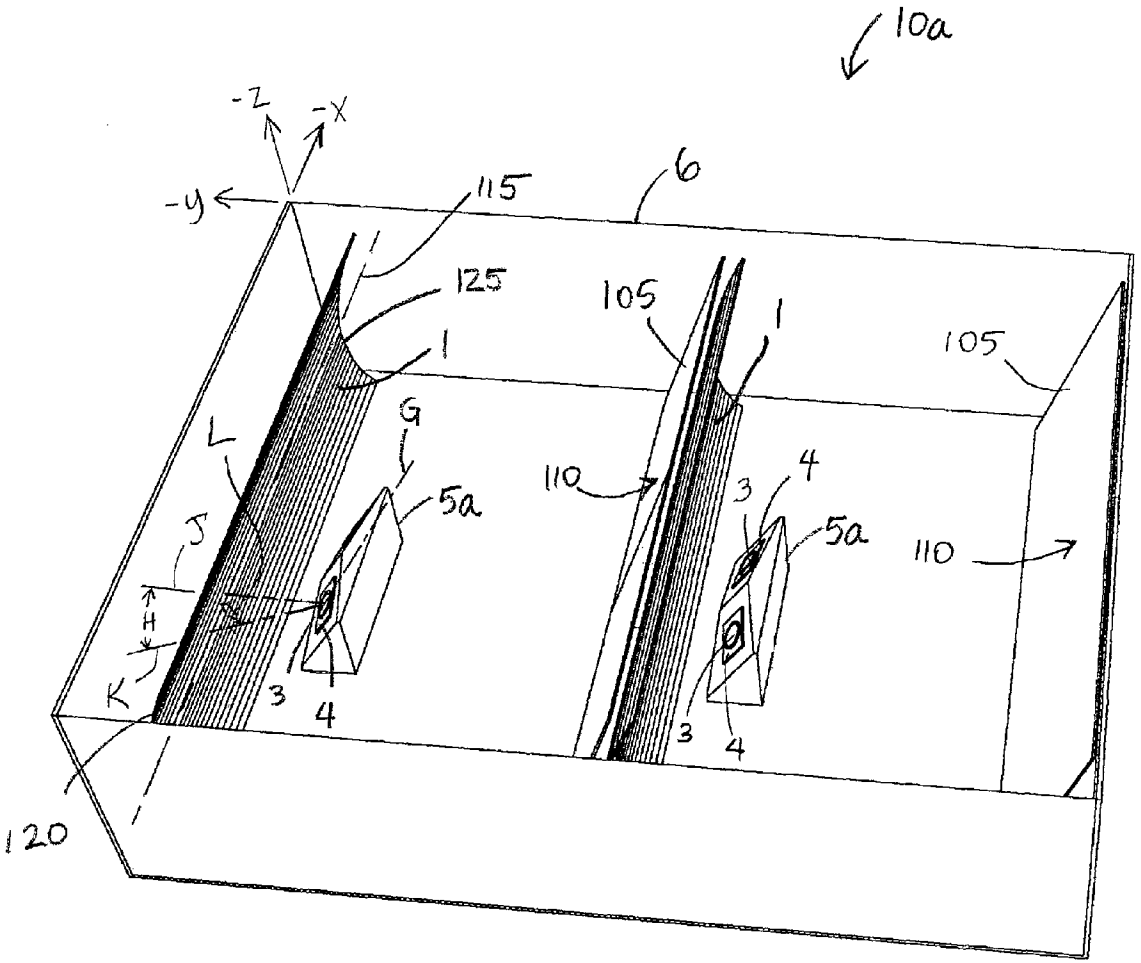
FIG. 25 is a bottom perspective view of a light fixture employing the emitter mounting block of FIGS. 24A-24D.

FIGS. 24A-25 illustrate another construction of the emitters 3 and PCB 4 mounted to an outwardly angled mounting block 5*a*, angled toward the ends of the primary reflector 1. The mounting block 5*a* may have heat sink properties, as described with respect to other constructions above. It should be understood that the mounting block 5*a* may be employed with any of the constructions and embodiments of light fixtures described in this application.

As described above with respect to FIG. 6, the emitters 3 are positioned at an angle E with respect to a horizontal plane, or output plane of the light fixture. The angle E shown in FIG. 24B is equivalent to the angle E shown in FIG. 6 by the laws of geometry. In the construction of FIGS. 24A-25, the emitters 3 are positioned at the angle E, described above, and additionally oriented about an axis G. The axis G is an axis of symmetry of the emitter 3, is parallel to the Y-Z plane (FIG. 24B) and defines the angle E with respect to the Z-axis, or an axis normal to the output plane of the light fixture, in FIG. 24B. The axis G also passes through a center point of the emitter 3. The emitter 3 is oriented about the axis G by an angle H (FIG. 24D) towards the outer portion of the primary reflector 1, such that the center point of the emitter remains at or near the focal point 40, 41, 42 of the parabolas of the primary reflector 1 as described above. In the illustrated construction, two emitters 3 are employed and each emitter 3 is oriented toward opposite ends of the housing 6, or opposite ends of the primary reflector 1, i.e., in opposite directions along the X-axis. The angle H is defined between a first axis of maximum intensity J, or central axis, and a second axis of maximum intensity K, or central axis. The first axis of maximum intensity J (FIG. 23) is an axis along which the maximum intensity light is emitted from the emitter 3, and is normal to the emitter 3 and passes through the center of the emitter 3, when the emitter is oriented to face the primary reflector 1 squarely, as shown in FIGS. 1-23. The second axis of maximum intensity K is an axis along which the maximum intensity light is emitted from the emitter 3, and is normal to the emitter 3 and passes through a center of the emitter 3, when the emitter 3 is oriented to face an end of the primary reflector 1, as shown in FIGS. 24A-25. In the illustrated construction, the axis of maximum intensity J, K coincides with a central axis of the emitter 3. In other constructions, the emitters 3 may not emit the maximum intensity of light along the central axis. The angle H is preferably between 5 and 35 degrees. In the illustrated construction, the angle H is approximately 15 degrees.

The second axis of maximum intensity K is oriented at the angle E, described above, with respect to an output plane 140 of the light fixture 10*a*. As is best illustrated in FIG. 6, the angle E is an included angle between the axis K and the output plane 140, and is between about 35 and 55 degrees. Preferably, the angle E is approximately 45 degrees.

The emitters 3 are oriented to direct the most powerful portion of the radiation pattern, i.e., the maximum intensity light, towards the outer portion of the primary reflector 1. In the illustrated construction, two emitters 3 are employed, each emitter 3 oriented towards an opposite outer portion of the primary reflector 1. This orientation has the effect of widening the ISO Ft-Cd plot, shown in FIG. 11, on the X-axis. For applications such as street light applications, widening the reach of light in the X-direction is advantageous because street lights can be spaced farther apart in the X-direction, reducing the number of light fixtures needed. In other constructions, one, three or more emitters 3 may be oriented as described above to achieve a desired effect.

The primary reflector 1, and more specifically, the reflective surface of the primary reflector 1, extends in a longitudinal direction parallel to a longitudinal axis 115, shown in FIG. 25, between a first longitudinal end 120 and a second longitudinal end 125. In the construction of FIGS. 1-23, the first axis of maximum intensity J is substantially normal to the longitudinal direction, or longitudinal axis 115. In the construction of FIGS. 24A-25, the axis of maximum intensity K is at an angle L with respect to the longitudinal direction of the reflective surface of the primary reflector 1, or longitudinal axis 115. Preferably, the angle L is between about 55 and about 85 degrees. In the illustrated construction, a first of the emitters 3 is oriented at the angle L such that the axis of maximum intensity K intersects the reflective surface of the primary reflector 1 closer to the first longitudinal end 115 than the second longitudinal end 120. A second of the emitters 3 is oriented at the angle L such that the axis of maximum intensity K intersects the reflective surface of the primary reflector 1 closer to the second longitudinal end 120 than the first longitudinal end 115. In other constructions, one or more emitters 3 can be employed at any angle with respect to the primary reflector 1 to achieve a desired output.

Every point on the reflective surface of the primary reflector 1 includes a tangent plane that is tangent thereto, which includes a normal axis that is normal thereto and intersects the point. Each normal axis is in, or parallel to, the Y-Z plane. At least a portion of the primary reflector 1 has a plurality of identical cross-sections in the Y-Z plane and has plurality of the normal axes, normal to the reflective surface as described above, that lie in the plane of each cross section, i.e., in the Y-Z plane or a plane parallel thereto. In the illustrated construction, the entire primary reflector 1 is constructed as such. Other constructions, such as the construction described above in which the primary reflector is formed of faceted surfaces or a plurality of flat sections, can also be described as such. In other words, the normal axes do not have an X-component. In the constructions of FIGS. 1-23, each emitter 3 has an axis of maximum intensity J that is parallel to the Y-Z plane, i.e., does not have an X-component and is therefore is parallel to a normal cross section of the primary reflector 1. In the construction of FIGS. 23A-24, at least one of the emitters 3 has an axis of maximum intensity K that is non-parallel to the Y-Z plane, i.e., the axis of maximum intensity K has a component in the X-direction. In other words, the axis of maximum intensity K is not coplanar with any of the normal axes of the portion of the reflective surface of the primary reflector 1.

Thus, the invention provides, among other things, a light fixture having a primary reflector including a plurality of substantially parabolic sections having increasing focal lengths. Various features and advantages of the invention are set forth in the following claims.

What is claimed is:

1. A light fixture including a housing, comprising:

a solid state light emitter coupled to the housing and configured to emit light in a path, the solid state light emitter comprising:

a first light-emitting portion configured to emit a first portion of the light;

a second light-emitting portion configured to emit a second portion of the light;

a reflector having a first reflective surface positioned in the path of the light emitted by the solid state light emitter, the first reflective surface comprising:

a first substantially parabolic section configured to reflect the first portion of the light, the first substantially parabolic section having a first focal point and a first focal length; and a second substantially parabolic section adjacent the first substantially parabolic section and configured to reflect the second portion of the light, the second substantially parabolic section having a second focal length greater than the first focal length and a second focal point; and a stray light reflector having a second reflective surface facing the first reflective surface, wherein the first reflective surface reflects a part of the light toward the stray light reflector, and wherein the stray light reflector is configured to reflect the part of the light.

2. The light fixture of claim 1, further comprising a third light-emitting portion configured to emit a third portion of the light, wherein the third portion of the light does not intersect the reflector.

3. The light fixture of claim 2, wherein the third portion of the light intersects at least one of the first portion of the light and the second portion of the light after the first portion of the light and the second portion of the light are reflected off of the reflector.

4. The light fixture of claim 1, further comprising an outlet, through which the first portion of the light and the second portion of the light are substantially directed after being reflected by the reflector.

5. The light fixture of claim 4, further comprising a third light-emitting portion configured to emit a third portion of the light, wherein the third portion of the light does not intersect the reflector, and wherein the third light-emitting portion is aimed toward the outlet.

6. The solid state light fixture of claim 4, wherein the outlet includes a substantially transparent material.

7. The solid state light fixture of claim 4, wherein the outlet includes a plurality of flutes that spread light in one direction only.

8. The light fixture of claim 4, wherein the outlet includes three points defining a plane, and wherein the solid state light emitter is positioned at an included angle of between 35 and 55 degrees with respect to the plane.

9. The light fixture of claim 8, wherein the included angle is substantially 45 degrees.

10. The light fixture of claim 8, wherein the stray light reflector is angled between about 5 and about 85 degrees with respect to the plane.

11. The light fixture of claim 4, wherein the stray light reflector reflects the part of the light toward the outlet.

12. The solid state light fixture of claim 1, further comprising a pair of secondary reflectors positioned substantially normal to the first reflector, wherein a first of the pair of secondary reflectors is adjacent a first end of the first reflector, wherein a second of the pair of secondary reflectors is adjacent a second end of the first reflector.

13. The light fixture of claim 1, wherein the solid state light emitter is mounted to a printed circuit board.

14. The light fixture of claim 13, wherein the printed circuit board is mounted to a heat sink.

15. The light fixture of claim 1, wherein the second focal point is proximate the first focal point.

16. The light fixture of claim 1, wherein the solid state light emitter is located proximate the first focal point.

17. The light fixture of claim 1, further comprising a third substantially parabolic section configured to reflect a third portion of the light, the third substantially parabolic section having a third focal length greater than the second focal length and a third focal point.

18. The light fixture of claim 1, further comprising a second solid state light emitter coupled to the housing and second reflector having a second reflective surface configured to reflect at least a portion of light emitted by the second solid state light emitter.

19. The light fixture of claim 18, wherein the second reflector is positioned normal to the first reflector.

20. The light fixture of claim 19, further including a third reflector positioned normal to the second reflector, a third solid state light emitter, a fourth reflector positioned normal to the third reflector, and a fourth solid state light emitter.

21. The light fixture of claim 1, further comprising a third section adjacent the second substantially parabolic section configured to reflect a third portion of the light, wherein the third section is substantially straight.

22. The light fixture of claim 1, further comprising a third section adjacent the second substantially parabolic section configured to reflect a third portion of the light, wherein the third section is substantially arcuate.

23. The light fixture of claim 1, wherein the first substantially parabolic section is formed from a plurality of substantially flat sections.

24. The light fixture of claim 23, wherein the second substantially parabolic section is formed from a plurality of substantially flat sections.

25. The light fixture of claim 1, wherein the first substantially parabolic section is formed from a plurality of substantially arcuate sections.

26. The light fixture of claim 25, wherein the second substantially parabolic section is formed from a plurality of substantially arcuate sections.

27. The light fixture of claim 1, further comprising a second solid state light emitter positioned adjacent the first solid state light emitter and positioned at the same distance from the reflector as the first solid state light emitter.

28. A light fixture including a housing, comprising:

a solid state light emitter coupled to the housing and configured to emit light in a path, the solid state light emitter comprising:

a first light-emitting portion configured to emit a first portion of the light;

a second light-emitting portion configured to emit a second portion of the light; and a reflector having a reflective surface positioned in the path of the light emitted by the solid state light emitter, at least a portion of the reflective surface having a longitudinal axis extending in a longitudinal direction, the reflective surface comprising:

a first substantially parabolic section configured to reflect the first portion of the light, the first substantially parabolic section having a first focal point and a first focal length; and a second substantially parabolic section adjacent the first substantially parabolic section and configured to reflect the second portion of the light, the second substantially parabolic section having a second focal length greater than the first focal length and a second focal point; and wherein the solid state light emitter includes an axis of maximum intensity oriented to be oblique to the longitudinal axis of the reflective surface.

29. The light fixture of claim 28, wherein the axis of maximum intensity is oriented between about 55 and about 85 degrees with respect to the longitudinal axis of the reflective surface.

30. The light fixture of claim 28, further comprising a second solid state light emitter having a second axis of maximum intensity, wherein the second axis of maximum intensity is oriented to be oblique to the longitudinal axis of the reflective surface, wherein the reflective surface extends in the longitudinal direction between a first longitudinal end and a second longitudinal end, and wherein the first axis of maximum intensity intersects the reflective surface closer to the first longitudinal end than to the second longitudinal end, and the second axis of maximum intensity intersects the reflective surface closer to the second longitudinal end than to the first longitudinal end.

31. The light fixture of claim 28, wherein the reflector includes a plurality of tangent planes tangent to a plurality of points on at least a portion of the reflective surface, wherein a normal axis is defined by each of the plurality of tangent planes at the location of the respective point, and wherein the solid state light emitter includes an axis of maximum intensity that is not coplanar with any of the normal axes.

32. The light fixture of claim 31, further comprising a second solid state light emitter having a second axis of maximum intensity that is not coplanar with any of the normal axes.

33. The light fixture of claim 28, further comprising an outlet through which the first portion of the light and the second portion of the light are substantially directed after being reflected by the reflector, wherein the outlet includes three points defining an output plane, and wherein the axis of maximum intensity is positioned at an included angle of between 35 and 55 degrees with respect to the output plane.

* * * * *